US009552821B2

(12) United States Patent
Moriya et al.

(10) Patent No.: US 9,552,821 B2
(45) Date of Patent: Jan. 24, 2017

(54) ENCODING METHOD, ENCODER, PROGRAM AND RECORDING MEDIUM

(71) Applicant: NIPPON TELEGRAPH AND TELEPHONE CORPORATION, Chiyoda-ku (JP)

(72) Inventors: Takehiro Moriya, Kanagawa (JP); Yutaka Kamamoto, Kanagawa (JP); Noboru Harada, Kanagawa (JP); Yusuke Hiwasaki, Tokyo (JP); Masahiro Fukui, Tokyo (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 7 days.

(21) Appl. No.: 14/394,158

(22) PCT Filed: May 29, 2013

(86) PCT No.: PCT/JP2013/064877

§ 371 (c)(1),
(2) Date: Oct. 13, 2014

(87) PCT Pub. No.: WO2013/180164

PCT Pub. Date: Dec. 5, 2013

(65) Prior Publication Data

US 2015/0088529 A1 Mar. 26, 2015

(30) Foreign Application Priority Data

May 30, 2012 (JP) ..... 2012-122785

(51) Int. Cl.
*G10L 19/24* (2013.01)
*G10L 19/002* (2013.01)
(Continued)

(52) U.S. Cl.
CPC ..... *G10L 19/032* (2013.01); *G10L 19/035* (2013.01); *G10L 19/083* (2013.01)

(58) Field of Classification Search
CPC .... G10L 19/24; G10L 21/0208; G10L 19/002; G10L 15/063; G10L 21/038; G10L 19/035; H03G 3/3089; H03G 3/301; H03G 7/007; H03G 3/00; H03G 3/20
(Continued)

(56) References Cited

U.S. PATENT DOCUMENTS

2003/0083867 A1 5/2003 Lopez-Estrada et al.
2004/0162723 A1 8/2004 Lopez-Estrada et al.
(Continued)

FOREIGN PATENT DOCUMENTS

KR 10-2006-0022821 A 3/2006

OTHER PUBLICATIONS

Office Action issued on Nov. 6, 2015 in Korean Patent Application No. 10-2014-7032029 with English translation.
(Continued)

*Primary Examiner* — Marivelisse Santiago Cordero
*Assistant Examiner* — Stephen Brinich
(74) *Attorney, Agent, or Firm* — Oblon, McClelland, Maier & Neustadt, L.L.P.

(57) ABSTRACT

A value of gain is updated so that the greater the difference between the number of bits or estimated number of bits in a code obtained by encoding a string of integer value samples obtained by dividing each sample in a sample string derived from an input audio signal in a given interval by gain before the update and a predetermined number B of allocated bits, the greater the difference between the gain before the update and the updated gain. A gain code corresponding to the updated gain and an integer signal code obtained by encoding a string of integer value samples obtained by dividing each sample in the sample string by the gain are obtained.

29 Claims, 6 Drawing Sheets

(51) Int. Cl.
*G10L 19/032* (2013.01)
*G10L 19/035* (2013.01)
*G10L 19/083* (2013.01)

(58) Field of Classification Search
USPC ..... 704/224–225, 229–230, 234, 236
See application file for complete search history.

(56) References Cited

U.S. PATENT DOCUMENTS

| | | | | |
|---|---|---|---|---|
| 2006/0049899 | A1* | 3/2006 | De Ruijter | H03H 11/0444 333/215 |
| 2006/0053006 | A1 | 3/2006 | Kim et al. | |
| 2006/0104531 | A1* | 5/2006 | Smith | H04N 19/15 382/251 |
| 2008/0065376 | A1 | 3/2008 | Osada | |
| 2008/0260016 | A1* | 10/2008 | Lapointe | H04B 3/04 375/233 |
| 2015/0341158 | A1* | 11/2015 | Wu | H04L 7/002 375/357 |

OTHER PUBLICATIONS

Partial European Search Report issued Oct. 8, 2015 in European Patent Application No. 13796771.7.
Extended Search Report issued Mar. 10, 2016 in European Patent Application No. 13796771.7.

* cited by examiner

ENCODING METHOD, ENCODER, PROGRAM AND RECORDING MEDIUM

TECHNICAL FIELD

The present invention relates to an encoding technique for audio signals and, in particular, to an encoding technique to encode a sequence obtained by dividing a sample string derived from an audio signal by gain.

BACKGROUND ART

Adaptive encoding that encodes orthogonal coefficients such as DFT (Discrete Fourier Transform) and MDCT (Modified Discrete Cosine Transform) coefficients is known as a method for encoding speech signals and audio signals at low bit rates (for example about 10 to 20 Kbits/s). For example, AMR-WB+ (Extended Adaptive Multi-Rate Wideband), which is a standard technique, has the TCX (transform coded excitation) encoding mode. In the TCX encoding, gain is determined for a coefficient string obtained by normalizing an audio digital signal sequence in the frequency domain with a power spectrum envelope coefficient string so that a sequence obtained by dividing each of the coefficient in the coefficient string by the gain can be encoded with a predetermined number of bits.

<TCX Encoder 1000>

FIG. 1 illustrates an exemplary configuration of an encoder 1000 that performs conventional TCX encoding. Components in FIG. 1 will be described below.

<Frequency-Domain Transformer 1001>

A frequency-domain transformer 1001 transforms an input audio digital signal to an MDCT coefficient string X(1), . . . , X(N) at N points in the frequency domain on a frame-by-frame basis in a given time period and outputs the MDCT coefficient string. Here, N is a positive integer.

<Power-Spectrum-Envelope-Coefficient-String Arithmetic Unit 1002>

A power-spectrum-envelope-coefficient-string arithmetic unit 1002 performs linear prediction analysis of an audio digital signal in each frame to obtain liner predictive coefficients and uses the linear predictive coefficients to obtain and output a power spectrum envelope coefficient string W(1), . . . , W(N) of the audio digital signal at N points.

<Weighted Envelope Normalizer 1003>

A weighted envelope normalizer 1003 uses a power spectrum envelope coefficient string obtained by the power-spectrum-envelope-coefficient-string arithmetic unit 1002 to normalize each of the coefficients in an MDCT coefficient string obtained by the frequency-domain transformer 1001 and outputs a weighted normalized MDCT coefficient string $X_N(1), \ldots, X_N(N)$. Here, in order to achieve quantization that auditorily minimizes distortion, the weighted envelope normalizer 1003 uses a weighted power spectrum envelope coefficient string obtained by moderating a power spectrum envelope to normalize the coefficients in the MDCT coefficient strings on a frame-by-frame basis. As a result, the weighted normalized MDCT coefficient string $X_N(1), \ldots, X_N(N)$ does not have a steep slope of amplitude or large variations in amplitude as compared with the input MDCT coefficient string but has variations in magnitude similar to those of the power spectrum envelope coefficient string of the audio digital signal. That is, the weighted normalized MDCT coefficient string has somewhat greater amplitudes in a region of coefficients corresponding to low frequencies and has a fine structure due to a pitch period.

<Initializer 1004>

An initializer 1004 sets an initial value of gain (global gain) g. The initial value of the gain can be determined from the energy of a weighted normalized MDCT coefficient string $X_N(1), \ldots, X_N(N)$ and the number of bits allocated beforehand to an encode output from a variable-length encoder 1006, for example. The number of bits allocated beforehand to a code output from the variable-length encoder 1006 is hereinafter referred to as the number B of allocated bits. The initializer also sets 0 as the initial value of the number of updates of gain.

<Gain Update Loop Processor 1130>

A gain update loop processor 1130 determines gain such that a sequence obtained by dividing each coefficient in a weighted normalized MDCT coefficient string $X_N(1), \ldots, X_N(N)$ by the gain can be encoded with a predetermined number of bits, and outputs an integer signal code obtained by variable length encoding of the sequence obtained by dividing each coefficient in the weighted normalized MDCT coefficient string $X_N(1), \ldots, X_N(N)$ by the determined gain and a gain code obtained by encoding the determined gain.

The update loop processor 1130 includes a quantizer 1005, the variable-length encoder 1006, a determiner 1007, a gain expansion updater 1131, a gain reduction updater 1132, a truncation unit 1016, and a gain encoder 1017.

<Quantizer 1005>

The quantizer 1005 quantizes a value obtained by dividing each coefficient in a weighted normalized MDCT coefficient string $X_N(1), \ldots, X_N(N)$ by gain g to obtain and output a quantized normalized coefficient sequence $X_Q(1), \ldots, X_Q(N)$, which is a sequence of integer values.

<Variable-Length Encoder 1006>

The variable-length encoder 1006 encodes a quantized normalized coefficient sequence $X_Q(1), \ldots, X_Q(N)$ to obtain and output a code. The code is referred to as integer signal code. The variable-length encoding may use a method that encodes a plurality of coefficients in a quantized normalized coefficient string at a time, for example. In addition, the variable-length encoder 1006 measures the number of bits in the integer signal code obtained by the variable-length encoding. The number of bits is hereinafter referred to as the number c of consumed bits.

<Determiner 1007>

The determiner 1007 outputs gain, integer signal code, and the number c of consumed bits when the number of updates of gain is equal to a predetermined number.

When the number of updates of gain is less than the predetermined number, the determiner 1007 performs control to cause a gain expansion updater 1131 to perform a next process if the number c of consumed bits measured by the variable-length encoder 1006 is greater than the number B of allocated bits, or to cause a gain reduction updater 1132 to perform a next process if the number c of consumed bits measured by the variable-length encoder 1006 is smaller than the number B of allocated bits. Note that if the number c of consumed bits is equal to the number B of allocated bits, it means that the current value of gain is optimum and therefore the determiner 1007 outputs the gain, the integer signal code and the number c of consumed bits.

<Gain Expansion Updater 1131>

The gain expansion updater 1131 sets a value greater than the current value of gain g as new gain g'>g. The gain expansion updater 1131 includes a lower limit gain setter 1008, a first branch controller 1009, a first gain updater 1010, and a gain expander 1011.

<Lower Limit Gain Setter 1008>

The lower limit gain setter 1008 sets the current value of gain g as the lower limit gain $g_{min}$ ($g_{min} \leftarrow g$). The lower limit gain $g_{min}$ means the lowest value of gain allowed.

<First Branch Controller 1009>

When the lower limit gain $g_{min}$ is set by the lower limit gain setter 1008, the first branch controller 1009 performs control to cause the first gain updater 1010 to perform a next process if an upper limit gain value $g_{max}$ has been already set or to cause the gain expander 1011 to perform a next process if the upper limit gain $g_{max}$ has not been set.

<First Gain Updater 1010>

The first gain updater 1010 sets the average of the current value of gain g and the upper limit gain $g_{max}$ as a new value of gain g ($g \leftarrow (g+g_{max})/2$). This is because an optimum value of gain is between the current value of gain g and the upper limit gain $g_{max}$. Since the current value of gain g has been set as the lower limit gain $g_{min}$, it can be said that the average of the upper limit gain $g_{max}$ and the lower limit gain $g_{min}$ is set as a new value of gain g ($g \leftarrow (g_{max}+g_{min})/2$). Then the control returns to the process in the quantizer 1005.

<Gain Expander 1011>

The gain expander 1011 sets a value greater than the current value of gain g as a new value of gain g. For example, the gain expander 1011 sets a value that is equal to the current value of gain g plus a gain change amount Δg, which is a predetermined value, as a new value of gain g ($g \leftarrow g+\Delta g$). If the upper limit gain $g_{max}$ has not been set and the number c of consumed bits has been greater than the number B of allocated bits successive times, for example, a value greater than the predetermined value is used as the gain change amount Δg. Then the control returns to the process in the quantizer 1005.

<Gain Reduction Updater 1132>

The gain reduction updater 1132 sets a value smaller than the current value of gain g as a new gain g'<g. The gain reduction updater 1132 includes an upper limit gain setter 1012, a second branch controller 1013, a second gain updater 1014, and a gain reducer 1015.

<Upper Limit Gain Setter 1012>

The upper limit gain setter 1012 sets the current value of gain g as the upper limit gain $g_{max}$ ($g_{max} \leftarrow g$). The upper limit gain $g_{max}$ means the highest gain allowed.

<Second Branch Controller 1013>

When the upper limit gain $g_{max}$ is set by the upper limit gain setter 1012, the second branch controller 1013 performs control to cause the second gain updater 1014 to perform a next process if the lower limit gain $g_{min}$ has already been set or to cause the gain reducer 1015 to perform a next process if the lower limit gain $g_{min}$ has not yet been set.

<Second Gain Updater 1014>

The second gain updater 1014 sets the average of the current the current value of gain g and the lower limit gain $g_{min}$ as a new value of gain g ($g \leftarrow (g+g_{min})/2$). This is because an optimum gain value is between the current value of gain g and the lower limit gain $g_{min}$. Since the current value of gain g has been set as the upper limit gain $g_{max}$, it can be said that the average of the upper limit gain $g_{max}$ and the lower limit gain $g_{min}$ is set as a new value of gain g ($g \leftarrow (g_{max}+g_{min})/2$). Then the control returns to the process in the quantizer 1005.

<Gain Reducer 1015>

The gain reducer 1015 sets a value smaller than the current value of gain g as a new value of gain g. For example, the gain reducer 1015 sets a value equal to the current value of gain g minus a gain change amount Δg, which is a predetermined value, as a new value of gain g ($g \leftarrow g-\Delta g$). If the lower limit gain $g_{min}$ has not been set and the number c of consumed bits has been smaller than the number B of allocated bits successive times, for example, a value greater than the predetermined value is used as the gain change amount Δg. Then the control returns to the process in the quantizer 1005.

<Truncation Unit 1016>

When the number c of consumed bits output from the determiner 1007 is greater than the number B of allocated bits, the truncation unit 1016 removes an amount of code equivalent to bits by which the number c of consumed bits exceeds the number B of allocated bits from the code corresponding to quantized normalized coefficients at the high frequency side in an integer signal code output from the determiner 1007 and outputs the resulting code as a new integer signal code. That is, the truncation unit 1016 removes the amount of code equivalent to the number of bits c−B by which the number c of consumed bits exceeds the number B of allocated bits that corresponds to quantized normalized coefficients at the high frequency side from the integer signal code and outputs the remaining code as a new integer signal code.

<Gain Encoder 1017>

The gain encoder 1017 encodes gain output from the determiner 1007 with a predetermined number of bits to obtain and output a gain code.

PRIOR ART LITERATURE

Non-Patent Literature

Non-patent literature 1: 3rd Generation Partnership Project (3GPP), Technical Specification (TS) 26290, "Extended Adaptive Multi-Rate-Wideband (AMR-WB+) codec; Transcoding functions", Version 10.0.0 (2011-03)

SUMMARY OF THE INVENTION

Problems to be Solved by the Invention

The gain expander 1011 of the conventional encoder 1000 sets a value of gain g plus a gain change amount Δg, which is a predetermined value, as a new value of gain g to expand the value of gain at a constant rate.

If the upper limit gain is not set and the process in the gain expander 1011 needs to be repeated a number of times, the initial value of gain may be far too small. Therefore the gain change amount Δg needs to be increased above the predetermined value to increase the probability of the upper limit gain being reached. As a result, however, a value that is significantly greater than an optimum gain can possibly be set as a new value of gain, the process may need to be repeated many times to achieve convergence, and a specified number of time may be reached before an appropriate value of gain can be obtained.

Similarly, the gain reducer 1015 of the conventional encoder 1000 sets a value of gain g minus a gain change amount Δg, which is a predetermined value, as a new value of gain g to reduce the value of gain at a constant rate.

If the upper limit gain is not set and the process in the gain reducer 1015 needs to be repeated a number of times, the initial value of gain may be far too large. Therefore the gain change amount Δg needs to be increased above the predetermined value to increase the probability of the upper limit gain being reached. As a result, however, a value that significantly greater than an optimum gain can possibly be set as a new value of gain, the process may need to be repeated many times to achieve convergence, and a specified number of time may be reached before an appropriate value of gain can be obtained.

If a value obtained when the specified number of times is reached is too small, the number of bits in a code obtained by variable-length encoding is greater than the number of allocated bits and therefore only part of the code obtained by variable-length encoding can be output as an integer signal code and code corresponding to quantized normalized coefficients in a high-frequency band are not output from the encoder and are not provided to the decoder. Consequently, the decoder has to use 0 as coefficients in the high-frequency band to obtain a decoded signal, which can lead to a large distortion of the decoded signal. If the value of gain obtained when the specified number of times is reached is too large, the number of bits in the integer signal code is smaller than the number of allocated bits and therefore sufficiently good audio signal quality cannot be achieved.

Means to Solve the Problems

A value of gain is updated so that the greater the difference between the number of bits or estimated number of bits in a code obtained by encoding a string of integer value samples obtained by dividing each sample in a sample string derived from an input audio signal in a given interval by gain before the update and a predetermined number B of allocated bits, the greater the difference between the gain before the update and the updated gain. A gain code corresponding to the updated gain and an integer signal code obtained by encoding a string of integer value samples that can be obtained by dividing each sample in the sample string by the gain are obtained.

Effects of the Invention

Encoding according to the present invention facilitates convergence of gain to an optimum value. Accordingly, the number of bits in a code obtained by variable-length encoding can be made closer to the number of allocated bits than possible with the conventional technique and encoding of higher quality can be achieved than the quality that can be achieved with the conventional technique.

DETAILED DESCRIPTION OF THE EMBODIMENTS

Figure 1:
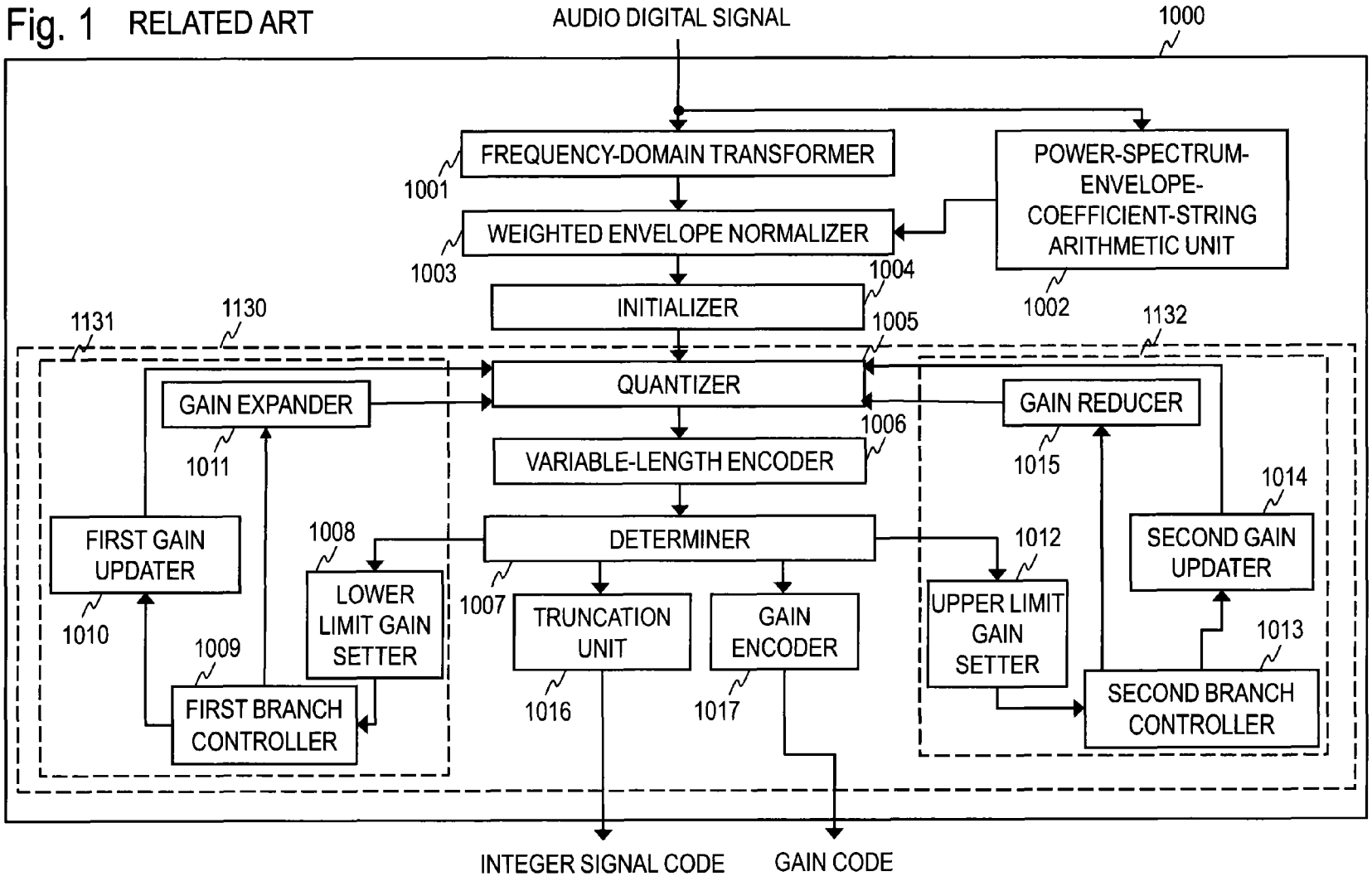
Fig. 1 RELATED ART
FIG. 1 is a block diagram illustrating a configuration of a conventional encoder.

Embodiments of the present invention will be described with reference to drawings. Same components or processes are assigned same reference numerals and repeated description of those components and processes may be omitted. Note that audio digital signals (input audio signals) handled in the embodiments are signals produced by digitizing audio signals such as speech or music. It is assumed in the embodiments that an input audio digital signal is a time-domain signal in a given time period, the audio digital signal is transformed to a frequency-domain signal and a string obtained by normalizing the frequency-domain signal using a power spectrum envelope coefficient string is a sample string to be encoded (a sample string derived from the input audio signal). However, an input audio digital signal may be a time-domain signal in a given time period and the audio digital signal may be a sample string to be encoded, or a residual signal obtained by linear prediction analysis of the audio digital signal may be a sample string to be encoded, or a frequency-domain signal transformed from the audio digital signal may be a sample string to be encoded. Alternatively, an input audio digital signal may be a frequency-domain signal in a given interval (a frequency-domain signal corresponding to a given time period or a frequency-domain signal in a given frequency interval of the frequency domain signal) and the audio digital signal may be a sample string to be encoded, or a time-domain signal transformed from the audio digital signal may be a sample string to be encoded, or a residual signal obtained by linear prediction analysis of the time-domain signal may be a sample string to be encoded. That is, an input audio digital signal may be a time-domain signal or a frequency-domain signal and a sample string to be encoded may be a time-domain signal or a frequency-domain signal. Furthermore, any method of transforming a time-domain signal to a frequency-domain signal may be used and any method of transforming a frequency-domain signal to a time-domain signal may be used. For example, MDCT (Modified Discrete Cosine Transform) or DCT (Discrete Cosine Transform) or inverse transform of any of these may be used.

Based on the assumption described above, embodiments will be described with examples in which an encoder includes a frequency-domain transformer, a power-spectrum-envelope-coefficient-string arithmetic unit, and a weighted envelope normalizer and a sample string obtained in the weighted envelope normalizer is input in a quantizer. However, if an input audio digital signal itself is a sample string to be encoded, the frequency-domain transformer, the power-spectrum-envelope-coefficient-string arithmetic unit and the weighted envelope normalizer may be omitted and the sample string of the audio digital string may be directly input in the quantizer. If a residual signal obtained by linear prediction analysis of an audio digital signal that is an input time-domain signal is a sample string to be encoded, the encoder may include a linear prediction unit that takes an input of an audio digital signal and obtains linear predicative coefficients or coefficients that can be transformed to linear predictive coefficients and a residual arithmetic unit that obtains predictive residuals from a linear predication filter for the linear predictive coefficients and an audio digital signal in place of the frequency-domain transformer, the power-spectrum-envelope-coefficient-string arithmetic unit and the weighted envelope normalizer, and the a sample string of the residual signal may be input into the quantizer. If a frequency-domain signal transformed from an audio digital signal that is an input time-domain signal is a sample string to be encoded, the power-spectrum-envelope-coefficient-string arithmetic unit and the weighted envelope normalizer may be omitted and a sample string of a frequency-domain signal obtained in the frequency-domain transformer may be input into the quantizer. If a time-domain signal transformed from an audio digital signal that is an input frequency-domain signal is a sample string to be encoded, the encoder may include a time-domain transformer that transforms an audio digital signal to a time-domain signal in place of the frequency-domain transformer, the power-spectrum-envelope-coefficient-string arithmetic unit and the weighted envelope normalizer and a sample string of the time-domain signal may be input into the quantizer. If a residual signal obtained by linear prediction analysis of a time-domain signal transformed from an audio digital signal that is an input frequency-domain signal is a sample string to be encoded, the encoder may include a time-domain transformer, a linear prediction unit and a residual arithmetic unit in place of the frequency-domain transformer, the power-spectrum-envelope-coefficient-string arithmetic unit and the weighted envelope normalizer and a sample string of the residual signal obtained in the residual arithmetic unit may be input into the quantizer.

[First Embodiment]

<Encoder 100>

Figure 2:
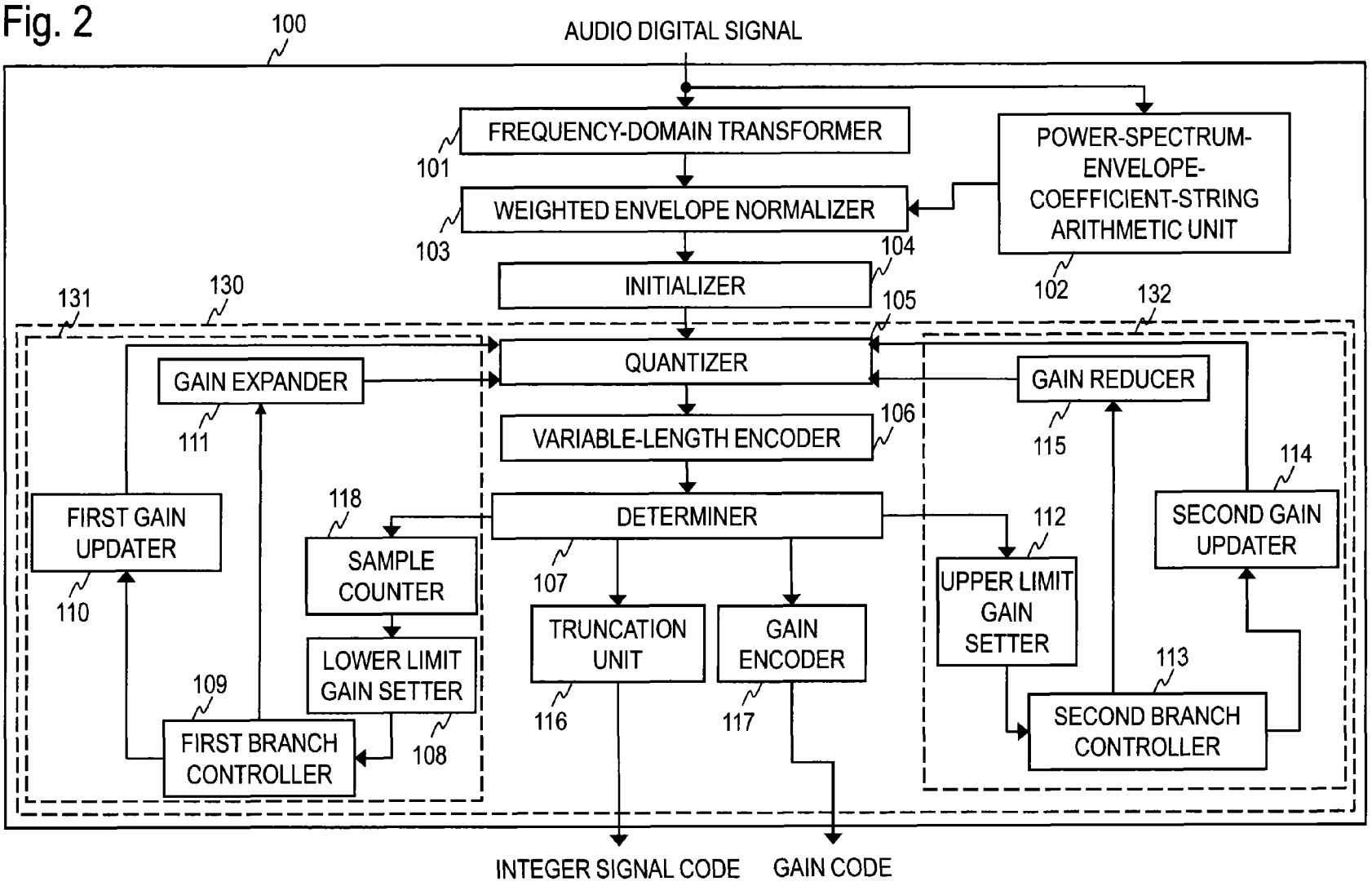
FIG. 2 is a block diagram illustrating a configuration of an encoder according to a first embodiment.

Referring to FIG. 2, an encoding process performed by an encoder 100 according to a first embodiment will be described.

<Frequency-Domain Transformer 101>

A frequency-domain transformer 101 transforms an input audio digital signal (input audio signal) to an MDCT coefficient string X(1), . . . , X(N) at N points in the frequency domain on a frame-by-frame basis in a given time period and outputs the MDCT coefficient string X(1), . . . , X(N), where N is a positive integer.

<Power-Spectrum-Envelope-Coefficient-String Arithmetic Unit 102>

A power-spectrum-envelope-coefficient-string arithmetic unit 102 performs frame-by-frame linear prediction analysis of an audio digital signal to obtain linear predictive coefficients, uses the linear predictive coefficients to obtain a power spectrum envelope coefficient string W(1), . . . , W(N) of the audio digital signal at N points and outputs the power spectrum envelope coefficient string W(1), . . . , W(N).

<Weighted Envelope Normalizer 103>

A weighted envelope normalizer 103 uses a power spectrum envelope coefficient string obtained by the power-spectrum-envelope-coefficient-string arithmetic unit 102 to normalize each of the coefficients in an MDCT coefficient string obtained by the frequency-domain transformer 101 and outputs a weighted normalized MDCT coefficient string $X_N(1), \ldots, X_N(N)$. Here, in order to achieve quantization that auditorily minimizes distortion, the weighted envelope normalizer 103 uses a weighted power spectrum envelope coefficient string obtained by moderating power spectrum envelope to normalize the coefficients in the MDCT coefficient string on a frame-by-frame basis. As a result, the weighted normalized MDCT coefficient string $X_N(1), \ldots, X_N(N)$ does not have a steep slope of amplitude or large variations in amplitude as compared with the input MDCT coefficient string but has variations in magnitude similar to those of the power spectrum envelope coefficient string of the audio digital signal, that is, the weighted normalized MDCT coefficient string has somewhat greater amplitudes in a region of coefficients corresponding to low frequencies and has a fine structure due to a pitch period.

[Examples of Weighted Envelope Normalization Process]

Coefficients W(1), . . . , W(N) of a power spectrum envelope coefficient string that correspond to the coefficients X(1), . . . , X(N) of an MDCT coefficient string at N points can be obtained by transforming linear predictive coefficients to a frequency domain. For example, according to a p-order autoregressive process (where p is a positive integer), which is an all-pole model, a time signal x(t) at a time t can be expressed by formula (1) with past values x(t−1), . . . , x(t−p) of the time signal itself at the past p time points, predictive residuals e(t) and linear predictive coefficients $\alpha_1, \ldots, \alpha_p$. Then, the coefficients W(n) [1≤n≤N] of the power spectrum envelope coefficient string can be expressed by formula (2), where exp(•) is an exponential function with a base of Napier's constant, j is an imaginary unit, and $\sigma^2$ is predictive residual energy.

$$x(t) + \alpha_1 x(t-1) + \ \ldots \ + \alpha_p x(t-p) = e(t) \tag{1}$$

$$W(n) = \frac{\sigma^2}{2\pi} \frac{1}{|1 + \alpha_1 \exp(-jn) + \alpha_2 \exp(-2jn) + \ \ldots \ + \alpha_p \exp(-pjn)|^2} \tag{2}$$

The linear predictive coefficients may be obtained by liner predictive analysis by the weighted envelope normalizer 103 of an audio digital signal input in the frequency-domain transformer 101 or may be obtained by linear predictive analysis of an sound digital signal by other means, not depicted, in the encoder 100. In that case, the weighted envelope normalizer 103 obtains the coefficients W(1), . . . , W(N) in the power spectrum envelope coefficient string by using a linear predictive coefficient. If the coefficients W(1), . . . , W(N) in the power spectrum envelope coefficient string have been already obtained with other means (such as the power-spectrum-envelope-coefficient-string arithmetic unit 102) in the encoder 100, the weighted envelope normalizer 103 can use the coefficients W(1), . . . , W(N) in the power spectrum envelope coefficient string. Note that since a decoder needs to obtain the same values obtained in the encoder 100, quantized linear predictive coefficients and/or power spectrum envelope coefficient strings are used. Hereinafter, the term "linear predictive coefficient" or "power spectrum envelope coefficient string" means a quantized linear predictive coefficient or a quantized power spectrum envelope coefficient string unless otherwise stated. The linear predictive coefficients are encoded using a conventional encoding technique and predictive coefficient code is then transmitted to the decoding side. The conventional encoding technique may be an encoding technique that provides code corresponding to liner predictive coefficients themselves as predictive coefficients code, an encoding technique that converts linear predictive coefficients to LSP parameters and provides code corresponding to the LSP parameters as predictive coefficient code, or an encoding technique that converts liner predictive coefficients to PARCOR coefficients and provides code corresponding to the PARCOR coefficients as predictive coefficient code, for example. If power spectrum envelope coefficients strings are obtained with other means provided in the encoder 100, other means in the encoder 100 encodes the linear predictive coefficients by a conventional encoding technique and transmits predictive coefficient code to the decoding side.

While two examples of a weighing envelope normalization process will be given here, the present invention is not limited to the examples.

EXAMPLE 1

The weighted envelope normalizer 103 divides the coefficients X(1), . . . , X(N) in an MDCT coefficient string by correction $W_\gamma(1), \ldots, W_\gamma(N)$ of the coefficients in a power spectrum envelope coefficient string that correspond to the coefficients to obtain the coefficients $X(1)/W_\gamma(1), \ldots, X(N)/W_\gamma(N)$ in a weighted normalized MDCT coefficient string. The correction values $W_\gamma(n)$ $[1 \le n \le N]$ are given by formula (3), where $\gamma$ is a positive constant less than or equal to 1 and moderates power spectrum coefficients.

$$W_\gamma(n) = \frac{\sigma^2}{2\pi\left(1 + \sum_{i=1}^{p} \alpha_i \gamma^i \exp(-ijn)\right)^2} \tag{3}$$

EXAMPLE 2

The weighted envelope normalizer 103 raises the coefficients in a power spectrum envelope coefficient string that correspond to the coefficients $X(1), \ldots, X(N)$ in an MDCT coefficient string to the $\beta$-th power $(0<\beta<1)$ and divides the coefficients $X(1), \ldots, X(N)$ by the raised values $W(1)^\beta, \ldots, W(N)^\beta$ to obtain the coefficients $X(1)/W(1)^\beta, \ldots, X(N)/W(N)^\beta$ in a weighted normalized MDCT coefficient string.

As a result, a weighted normalized MDCT coefficient string in a frame is obtained. The weighted normalized MDCT coefficient string does not have a steep slope of amplitude or large variations in amplitude as compared with the input MDCT coefficient string but has variations in magnitude similar to those of the power spectrum envelope of the input MDCT coefficient string, that is, the weighted normalized MDCT coefficient string has somewhat greater amplitudes in a region of coefficients corresponding to low frequencies and has a fine structure due to a pitch period.

Note that the inverse process of the weighted envelope normalization process, that is, the process for reconstructing the MDCT coefficient string from the weighted normalized MDCT coefficient string, is performed at the decoding side, settings for the method for calculating weighted power spectrum envelope coefficient strings from power spectrum envelope coefficient strings need to be common between the encoding and decoding sides.

<Initializer 104>

An initializer 104 sets an initial value of gain (global gain) g. The initial value of the gain can be determined from the energy of a weighted normalized coefficient string $X_N(1), \ldots, X_N(N)$ and the number of bits allocated beforehand to code output from a variable-length encoder 106, for example. The initial value of gain g is a positive value. The number of bits allocated beforehand to code output from the variable-length encoder 106 is hereinafter referred to as the number of allocated bits B. The initializer also sets 0 as the initial value of the number of updates of gain.

<Gain Update Loop Processor 130>

A gain update loop processor 130 determines gain such that a sequence (a sequence of integer value samples) obtained by dividing each coefficient in a weighted normalized MDCT coefficient string $X_N(1), \ldots, X_N(N)$ by the gain can be encoded with a predetermined number of bits, and outputs an integer signal code obtained by variable length encoding of the sequence (the sequence of integer value samples) obtained by dividing the weighted normalized MDCT coefficient string $X_N(1), \ldots, X_N(N)$ by the determined gain and a gain code (the gain code corresponding to the gain) obtained by encoding the determined gain. The gain update loop processor 130 updates the value of gain so that the greater the difference between the number of bits in the code obtained by encoding the sequence of integer value samples and the given number of allocated bits B, the greater the difference between the gain before the update and the updated gain.

The gain update loop processor 130 includes a quantizer 105, the variable-length encoder 106, a determiner 107, a gain expansion updater 131, a gain reduction updater 132, a truncation unit 116, and a gain encoder 117.

<Quantizer 105>

The quantizer 105 quantizes a value obtained by dividing each coefficient (each sample) in an input weighted normalized MDCT coefficient string $X_N(1), \ldots, X_N(N)$ (a sample string derived from an input audio signal in a given interval) by gain g to obtain a quantized normalized coefficient sequence $X_Q(1), \ldots, X_Q(N)$ which is a sequence of integer values (quantized normalized samples) and outputs the quantized normalized coefficient sequence $X_Q(1), \ldots, X_Q(N)$.

The quantizer 105 also measures the number s of samples in the range from the quantized normalized coefficient at the lowest frequency to the quantized normalized coefficient which is not zero at the highest frequency and outputs the number s of samples.

<Variable-Length Encoder 106>

The variable-length encoder 106 encodes an input quantized normalized coefficient sequence $X_Q(1), \ldots, X_Q(N)$ by variable-length encoding to obtain and output a code (sample string code). The code is referred to as integer signal code. The variable-length encoding may use a method that encodes a plurality of coefficients in a quantized normalized coefficient string at a time, for example. In addition, the variable-length encoder 106 measures the number of bits in the integer signal code obtained by the variable-length encoding. In this embodiment, the number of bits is referred to as the number c of consumed bits.

<Determiner 107>

The determiner 107 outputs gain g, integer signal code, and the number c of consumed bits when the number of updates of gain is equal to a predetermined number.

When the number of updates of gain is less than the predetermined number, the determiner 107 performs control to cause a gain expansion updater 131 to perform a next process if the number c of consumed bits measured by the variable-length encoder 106 is greater than the number B of allocated bits, or to cause a gain reduction updater 132 to perform a next process if the number c of consumed bits measured by the variable-length encoder 106 is smaller than the number B of allocated bits. Note when the number c of consumed bits measured by the variable-length encoder 106 is equal to the number B of allocated bits, the determiner 107 outputs the gain g, the integer signal code and the number c of consumed bits.

<Gain Expansion Updater 131>

The gain expansion updater 131 sets a value greater than the current value of gain g as new gain g'>g. The gain expansion updater 131 includes a sample counter 118, a lower limit gain setter 108, a first branch controller 109, a first gain updater 110, and a gain expander 111.

<Sample Counter 118>

When the number c of consumed bits is greater than the number B of allocated bits, the sample counter 118 outputs the number t of samples of quantized normalized coefficients corresponding to a code remaining after removing an amount of code corresponding to quantized normalized coefficients at the high-frequency side from an integer signal code output from the determiner 107, so that the number c of consumed bits does not exceed the number B of allocated bits.

Specifically, the sample counter 118 outputs the number t of samples of quantized normalized coefficients that have been left after removing quantized normalized coefficients at the high frequency side that correspond to code (truncation code) corresponding to the amount c−B by which the number c of consumed bits exceeds the number B of allocated bits from a quantized normalized coefficient string output from the quantizer 105, that is, the number t of samples of quantized normalized coefficients whose corresponding code has not been removed. An example of truncation code is a code with a number of bits greater than or equal to c−B and the smallest among the code corresponding to one or more quantized normalized coefficients in a region including the highest frequency. In other words, t is the number of samples of quantized normalized coefficients to be encoded when the length of the corresponding variable-length code is less than or equal to the number B of allocated bits and is the largest by excluding quantized normalized coefficients at the high frequency side to leave only quantized normalized coefficients at the low frequency sides as coefficients to be encoded.

<Lower Limit Gain Setter 108>

When the number c of consumed bits is greater than the number B of allocated bits, the lower limit gain setter 108 sets the current value of gain g (gain g corresponding to the number c of consumed bits) as the lower limit gain $g_{min}$ ($g_{min} \leftarrow g$). The lower limit gain $g_{min}$ means the lowest value of gain allowed.

<First Branch Controller 109>

When the lower limit gain $g_{min}$ is set by the lower limit gain setter 108, the first branch controller 109 performs control to cause the first gain updater 110 to perform a next process if an upper limit gain value $g_{max}$ has been already set or to cause the gain expander 111 to perform a next process if the upper limit gain $g_{max}$ has not been set.

<First Gain Updater 110>

The first gain updater 110 sets a value between the current value of gain g (the value of gain g corresponding to the number c of consumed bits) and the upper limit gain $g_{max}$ as a new value of gain g. This is because an optimum value of gain is between the current value of gain g and the upper limit gain $g_{max}$. For example, the first gain updater 110 sets the average of the current value of gain g and the upper limit gain $g_{max}$ as a new value of gain g ($g \leftarrow (g+g_{max})/2$). Since the current value of gain g has been set as the lower limit gain $g_{min}$, it can be said that the average of the upper limit gain $g_{max}$ and the lower limit gain $g_{min}$ is set as a new value of gain g ($g \leftarrow (g_{max}+g_{min})/2$). Then the control returns to the process in the quantizer 105.

<Gain Expander 111>

The gain expander 111 increases the value of gain so that the greater the number s of samples in the range from the quantized normalized coefficient at the lowest frequency to the quantized normalized coefficient which is not zero at the highest frequency minus the number t of samples output from the sample counter 118, u=s−t, the greater the amount by which the current gain increases to a new gain. For example, the gain expander 111 increases the value of gain such that new gain g←current gain $g \times (1+u/N \times \alpha)$, where $\alpha$ is a predetermined positive constant.

Alternatively, the gain expander 111 increases the value of gain so that the greater the number N of all of the samples to be encoded minus the number t of samples output from the sample counter 118, v=N−t, the greater the amount by which the current gain increases to a new gain. For example, the gain expander 111 increases the value of gain such that new gain g←current gain $g \times (1+v/N \times \alpha)$.

Specifically, the greater the number of some or all of the samples in a quantized normalized sample string minus the number of samples of quantized normalized coefficients whose corresponding code has not been removed, the greater the amount by which the gain expander 111 increases the value of gain g. Then the control returns to the process in the quantizer 105. In other words, the gain expander 111 updates the value of gain so that the greater the number of some or all of the samples in a quantized normalized sample string minus the number of samples of quantized normalized coefficients whose corresponding code has not been removed, the greater the amount by which the value of gain before the update increases to an updated value. Then the gain expander 111 causes the quantizer 105 to perform the subsequent process.

<Gain Reduction Updater 132>

The gain reduction updater 132 sets a value smaller than the current value of gain g as a new gain g'<g. The gain reduction updater 132 includes an upper limit gain setter 112, a second branch controller 113, a second gain updater 114, and a gain reducer 115.

<Upper Limit Gain Setter 112>

When the number c of consumed bits is smaller than the number B of allocated bits, the upper limit gain setter 112 sets the current value of gain g (the value of gain g corresponding to the number c of consumed bits) as the upper limit gain $g_{max}$ ($g_{max} \leftarrow g$). The upper limit gain $g_{max}$ means the highest gain allowed.

<Second Branch Controller 113>

When the upper limit gain $g_{max}$ is set by the upper limit gain setter 112, the second branch controller 113 performs control to cause the second gain updater 114 to perform a next process if the lower limit gain $g_{min}$ has already been set or cause the gain reducer 115 to perform a next process if the lower limit gain $g_{min}$ has not yet been set.

<Second Gain Updater 114>

The second gain updater 114 sets a value between the current value of gain g (the value of gain g corresponding to the number c of consumed bit) and the lower limit gain $g_{min}$ as a new value of gain g. This is because an optimum value of gain is between the current value of gain g and the lower limit gain $g_{min}$. For example, the second gain updater 114 sets the average of the current value of gain g and the lower limit gain $g_{min}$ as a new value of gain g ($g \leftarrow (g+g_{min})/2$). Since the current value of gain g has been set as the upper limit gain $g_{max}$, it can be said that the average of the upper limit gain $g_{max}$ and the lower limit gain $g_{min}$ is set as a new value of gain g ($g \leftarrow (g_{max}+g_{min})/2$). Then the control returns to the process in the quantizer 105.

<Gain Reducer 115>

The gain reducer 115 reduces the value of gain g so that the greater the number of residual bits which is the number B of allocated bits minus the number c of consumed bits, B−c, the greater the amount by which the current value of gain g decreases to a new value of gain g. Here, the new value of gain g is also a positive value. For example, new gain g←current gain $g \times (1-(B-c)/B \times \beta)$, where $\beta$ is a predetermined positive constant. That is, the greater the number B of allocated bits minus the number c of consumed bits, B−c, the greater the amount by which the gain reducer 115 decreases the value of gain g. Then the control returns to the process in the quantizer 105. In other words, the gain reducer 115 updates the value of gain g so that the greater the number B of allocated bits minus the number c of consumed bits, B−c, the greater the amount by which the value of gain g before the update decreases to an updated value and then causes the quantizer 105 to perform the subsequent process.

<Truncation Unit 116>

When the number c of consumed bits output from the determiner 107 is greater than the number B of allocated bits, the truncation unit 116 removes an amount of code equivalent to bits by which the number c of consumed bits exceeds the number B of allocated bits from the code corresponding to quantized normalized coefficients at the high frequency side in an integer signal code output from the determiner 107 and outputs the resulting code as a new integer signal code. That is, the truncation unit 116 removes the amount of code (truncation code) equivalent to the number of bits c−B by which the number c of consumed bits exceeds the number B of allocated bits that corresponds to quantized normalized coefficients at the high frequency side from the integer signal code (sample string code) and outputs the remaining code (truncated sample string code) as a new integer signal code.

<Gain Encoder 117>

The gain encoder 117 encodes gain output from the determiner 107 with a predetermined number of bits to obtain and output a gain code.

[Modification of First Embodiment]

<Encoder 150>

Figure 3:
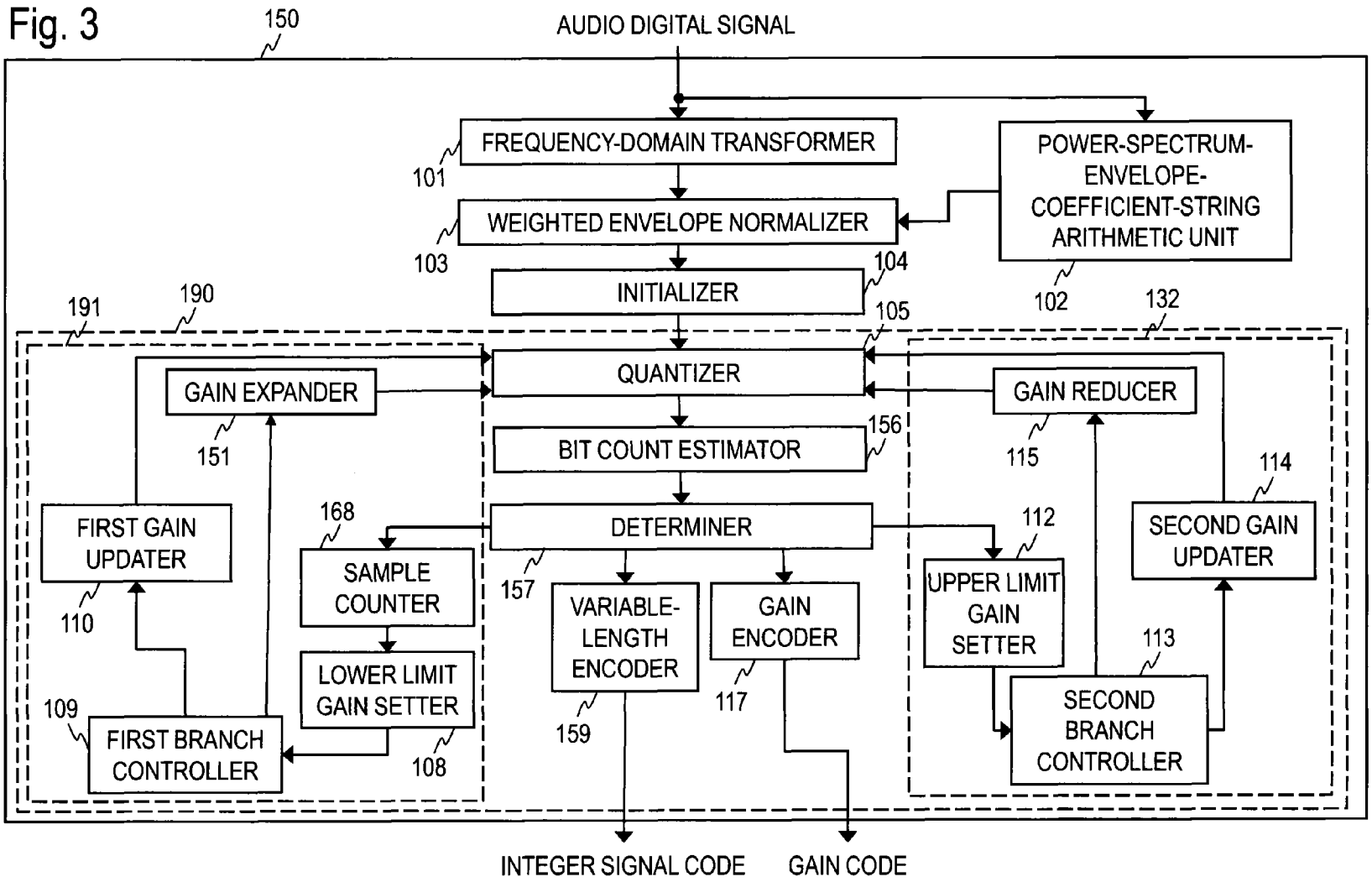
FIG. 3 is a block diagram illustrating a configuration of an encoder according to a modification of the first embodiment.

An encoding process performed by an encoder 150 of a modification of the first embodiment will be described with reference to FIG. 3. The encoder 150 of the modification of the first embodiment differs from the encoder 100 of the first embodiment in that the encoder 150 uses, instead of the number of bits in an integer signal code obtained by variable-length encoding, an estimated number of bits in an integer signal code as the number c of consumed bits. The encoder 150 includes a gain update loop processor 190 in place of the gain update loop processor 130 of the encoder 100. The gain update loop processor 190 includes a bit count estimator 156, a determiner 157, a gain expansion updater 191, and a variable-length encoder 159 in place of the variable-length encoder 106, the determiner 107, the gain expansion updater 131 and the truncation unit 116 of the gain update loop processor 130. The gain expansion updater 191 includes a gain expander 151 and a sample counter 168 in place of the gain expander 111 and the sample counter 118 of the gain expansion updater 131.

Differences from the first embodiments will be described below.

<Bit Count Estimator 156>

The bit count estimator 156 obtains an estimated value of the number of bits (estimated number of bits) in a code that can be obtained by variable-length encoding of a quantized normalized coefficient code sequence $X_Q(1), \ldots, X_Q(N)$. In the modification of the first embodiment, the estimated number of bits is referred to as the number c of consumed bits.

<Determiner 157>

The determiner 157 outputs gain g and a quantized normalized coefficient sequence $X_Q(1), \ldots, X_Q(N)$ when the number of updates of gain is equal to a predetermined number.

When the number of updates of gain is less than the predetermined number, the determiner 157 performs control to cause the gain expansion updater 191 to perform a next process if the number c of consumed bits estimated by the bit count estimator 156 is greater than the number B of allocated bits, or to cause the gain reduction updater 132 to perform a next process if the number c of consumed bits estimated by the bit count estimator 156 is smaller than the number B of allocated bits. Note if the number c of consumed bits estimated by the bit count estimator 156 is equal to the number B of allocated bits, the determiner 157 outputs gain g and a quantized normalized coefficient sequence $X_Q(1), \ldots, X_Q(N)$.

<Sample Counter 168>

When the number c of consumed bits is greater than the number B of allocated bits, the sample counter 168 outputs the number t of samples of quantized normalized coefficients that have been left after removing quantized normalized coefficients at the high frequency side that are directed to code (truncation code) corresponding to the amount c−B by which the number c of consumed bits exceeds the number B of allocated bits from a quantized normalized coefficient sequence $X_Q(1), \ldots, X_Q(N)$ output from the quantizer 105.

<Gain Expander 151>

The gain expander 151 is the same as the gain expander 111 of the first embodiment, except that the gain expander 151 uses the number t of samples output from the sample counter 168 instead of the number t of samples output from the sample counter 118 in the gain expander 111.

The gain expander 151 increases the value of gain so that the greater the number s of samples in the range from the quantized normalized coefficient at the lowest frequency to the quantized normalized coefficient which is not zero at the highest frequency minus the number t of samples output from the sample counter 118, u=s−t, the greater the amount by which the current gain increases to a new gain. For example, the gain expander 151 increases the value of gain such that new gain $g \leftarrow$current gain $g \times (1+u/N \times \alpha)$, where $\alpha$ is a predetermined positive constant.

Alternatively, the gain expander 151 increases the value of gain so that the greater the number N of all of the samples to be encoded minus the number t of samples output from the sample counter 118, v=N−t, the greater the amount by which the current gain increases to a new gain. For example, the gain expander 151 increases the value of gain such that new gain $g \leftarrow$current gain $g \times (1+v/N \times \alpha)$.

Specifically, the greater the number of some or all of the samples in a quantized normalized sample string minus the number of samples of quantized normalized coefficients whose corresponding code has not been removed, the greater the amount by which the gain expander 151 increases the value of gain g. Then the control returns to the process in the quantizer 105. In other words, the gain expander 111 updates the value of gain so that the greater the number of some or all of the samples in a quantized normalized sample string minus the number t of samples of quantized normalized coefficients left after removing quantized normalized coefficients at the high frequency side that are directed to the truncation code from a quantized normalized coefficient sequence $X_Q(1), \ldots, X_Q(N)$ output from the quantizer 105, the greater the amount by which the value of gain before the update increases to an updated value and then causes the quantizer 105 to perform the subsequent process.

<Variable-Length Encoder 159>

The variable-length encoder 159 encodes a quantized normalized coefficient sequence $X_Q(1), \ldots, X_Q(N)$ output from the determiner 157 by variable-length encoding to obtain a code and outputs the obtained code as an integer signal code (a sample string code). When the number of bits in the code obtained by the variable-length encoding exceeds the number B of allocated bits, the variable-length encoder 159 removes the amount of code by which the number B of allocated bits is exceeded from code corresponding to quantized normalized coefficients at the high-frequency side in the code obtained by the variable-length encoding and outputs the resulting code as an integer signal code.

[Second Embodiment]

<Encoder 200>

Figure 4:
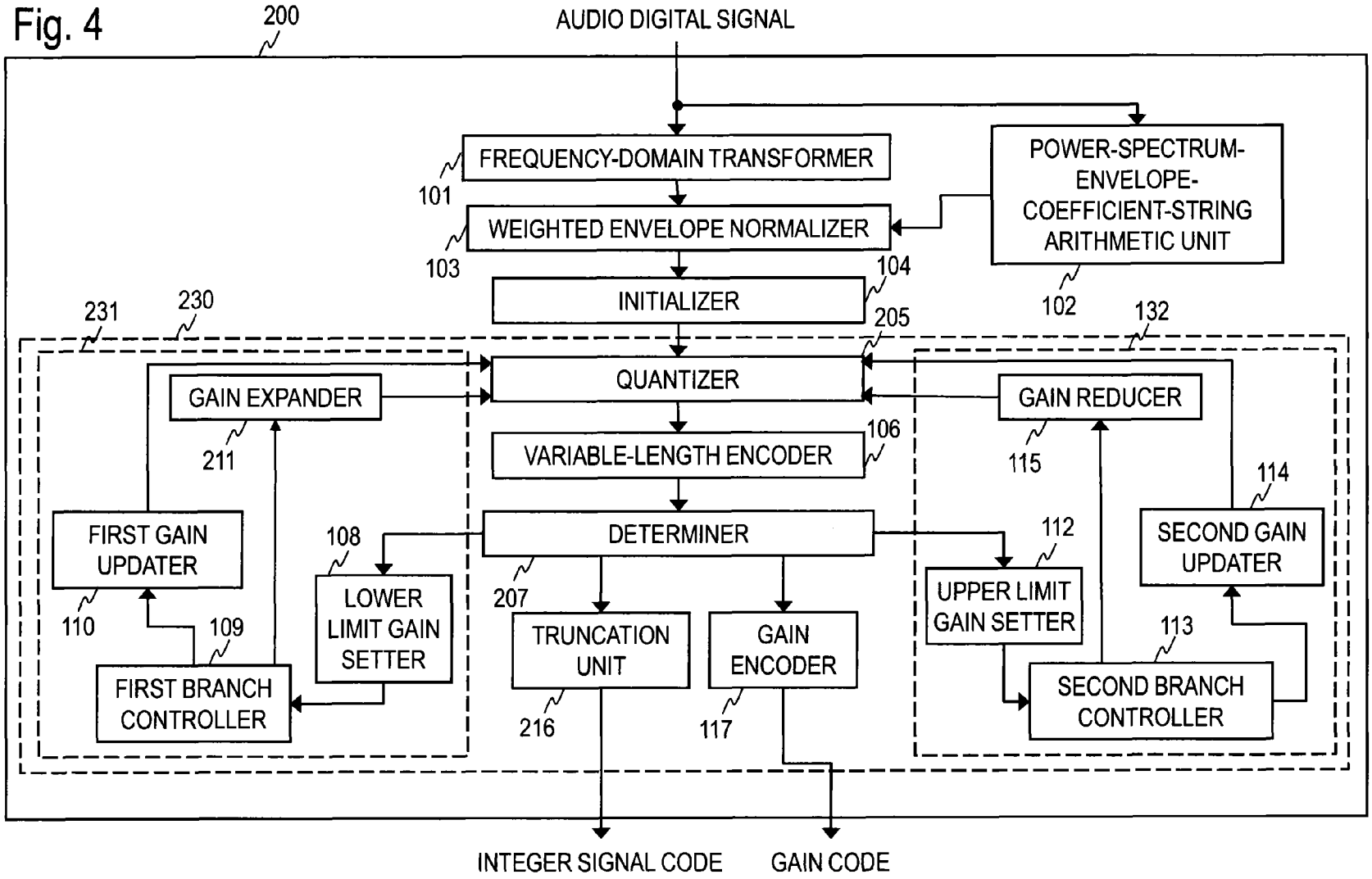
FIG. 4 is a block diagram illustrating configuration of an encoder according to a second embodiment.

An encoding process performed by an encoder 200 of a second embodiment will be described with reference to FIG. 4. The encoder 200 of the second embodiment differs from the encoder 100 of the first embodiment in that the encoder 200 includes a gain update loop processor 230 in place of the gain update loop processor 130, that the gain update loop processor 230 includes a quantizer 205, a determiner 207, a gain expansion updater 231, and a truncation unit 216 in place of the quantizer 105, the determiner 107, the gain expansion updater 131, and the truncation unit 116 of the gain update loop processor 130, and that the control returns to a process in the quantizer 205 instead of returning to the process in the quantizer 105 after the process performed by the first gain updater 110, the second gain updater 114 and the gain reducer 115. The gain expansion updater 231 does not include the sample counter 118 of the gain expansion updater 131 of the first embodiment but includes a lower limit gain setter 108, a first branch controller 109, a first gain updater 110 and a gain expander 211. Differences from the first embodiment will described below.

<Quantizer 205>

The quantizer 205 quantizes a value obtained by dividing each coefficient (each sample) in an input weighted normalized MDCT coefficient string $X_N(1), \ldots, X_N(N)$ (a sample string derived from an input audio signal in a given interval) by gain g to obtain a quantized normalized coefficient sequence $X_Q(1), \ldots, X_Q(N)$ which is a sequence of integer values (quantized normalized samples) and outputs the quantized normalized coefficient sequence $X_Q(1), \ldots, X_Q(N)$.

<Determiner 207>

The determiner 207 outputs gain, integer signal code, and the number c of consumed bits when the number of updates of gain is equal to a predetermined number.

When the number of updates of gain is less than the predetermined number, the determiner 207 performs control to cause the gain expansion updater 231 to perform a next process if the number c of consumed bits measured by the variable-length encoder 106 is greater than the number B of allocated bits, or to cause a gain reduction updater 132 to perform a next process if the number c of consumed bits measured by the variable-length encoder 106 is smaller than the number B of allocated bits. Note if the number c of consumed bits is equal to the number B of allocated bits, the determiner 207 outputs gain, the integer signal code and the number c of consumed bits.

<Truncation Unit 216>

When the number c of consumed bits output from the determiner 207 is greater than the number B of allocated bits, the truncation unit 216 removes an amount of code equivalent to bits by which the number c of consumed bits exceeds the number B of allocated bits from the code corresponding to quantized normalized coefficients at the high frequency side in an integer signal code output from the determiner 207 and outputs the resulting code as a new integer signal code. That is, the truncation unit 216 removes the amount of code (truncation code) equivalent to the number of bits c−B by which the number c of consumed bits exceeds the number B of allocated bits that corresponds to quantized normalized coefficients at the high frequency side from the integer signal code (sample string code) and outputs the remaining code (truncated sample string code) as a new integer signal code.

<Gain Expander 211>

The gain expander 211 increases gain so that the greater a shortfall of bits which is the number c of consumed bits minus the number B of allocated bits, c−B, the greater the amount by which the current gain increases to new gain. For example, new gain $g \leftarrow$ current gain $g \times (1+(c-B)/B \times \alpha)$, where $\alpha$ is a predetermined positive constant. That is, when the number c of consumed bits is greater than the number B of allocated bits and the upper limit gain $g_{max}$ has not been set, the gain expander 211 increases the value of gain g so that the greater the number c of consumed bits minus the number B of allocated bits, c−B, the greater the amount by which the value of gain g is increased. Then the control returns to the process in the quantizer 205. In other words, the gain expander 211 updates the value of gain g so that the greater the number c of consumed bits minus the number B of allocated bits, c−B, the greater the amount by which the value of gain g before the update increases to an updated value and causes the quantizer 205 to perform the subsequent process.

[Modification of Second Embodiment]

<Encoder 250>

Figure 5:
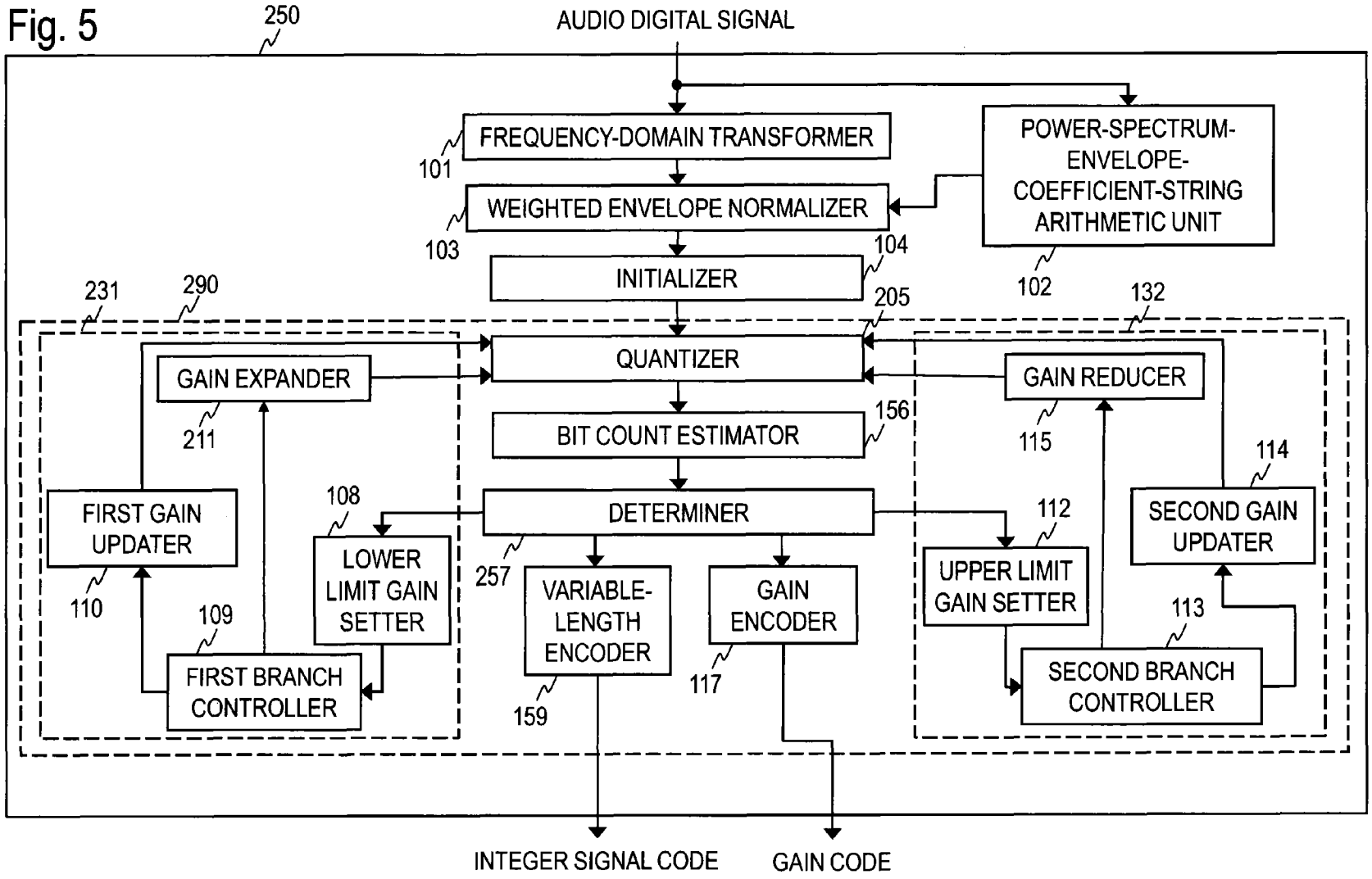
FIG. 5 is a block diagram illustrating a configuration of an encoder according to a modification of the second embodiment.

An encoding process performed by an encoder 205 of a modification of the second embodiment will be described with reference to FIG. 5. The encoder 250 of the modification differs from the encoder 200 of the second embodiment in that the encoder 250 uses, instead of the number of bits in an integer signal code obtained by variable-length encoding, an estimated number of bits in an integer signal code as the number c of consumed bits. The encoder 250 includes a gain update loop processor 290 in place of the gain update loop processor 230 of the encoder 200, the gain update loop processor 290 includes a bit count estimator 156, a variable-length encoder 159 and a determiner 257 in place of the variable-length encoder 106, the truncation unit 216 and the determiner 270 of the gain update loop processor 230. Differences from the second embodiment will be described below.

<Bit Count Estimator 156>

The bit count estimator 156 is the same as that of the modification of the first embodiment.

<Determiner 257>

When the number of updates of gain is equal to a predetermine number of updates, the determiner 257 outputs gain, a quantized normalized coefficient sequence, and the number c of consumed bits.

When the number of updates is less than the predetermined number of updates, the determiner 257 performs control to cause the gain expansion updater 231 to perform the process described in the first embodiment if the number c of consumed bits estimated by the bit count estimator 156 is greater than the number B of allocated bits, or to cause the gain reduction updater 132 to perform the process described in the first embodiment if the number c of consumed bits estimated by the bit count estimator 156 is less than the number B of allocated bits. Note that if the number c of consumed bits estimated by the bit count estimator 156 is equal to the number B of allocated bits, the determiner 257 outputs gain, a quantized normalized coefficient sequence, and the number c of consumed bits.

<Variable-Length Encoder 159>

The variable-length encoder 159 is the same as that of the modification of the first embodiment.

[Third Embodiment]

<Encoder 300>

Figure 6:
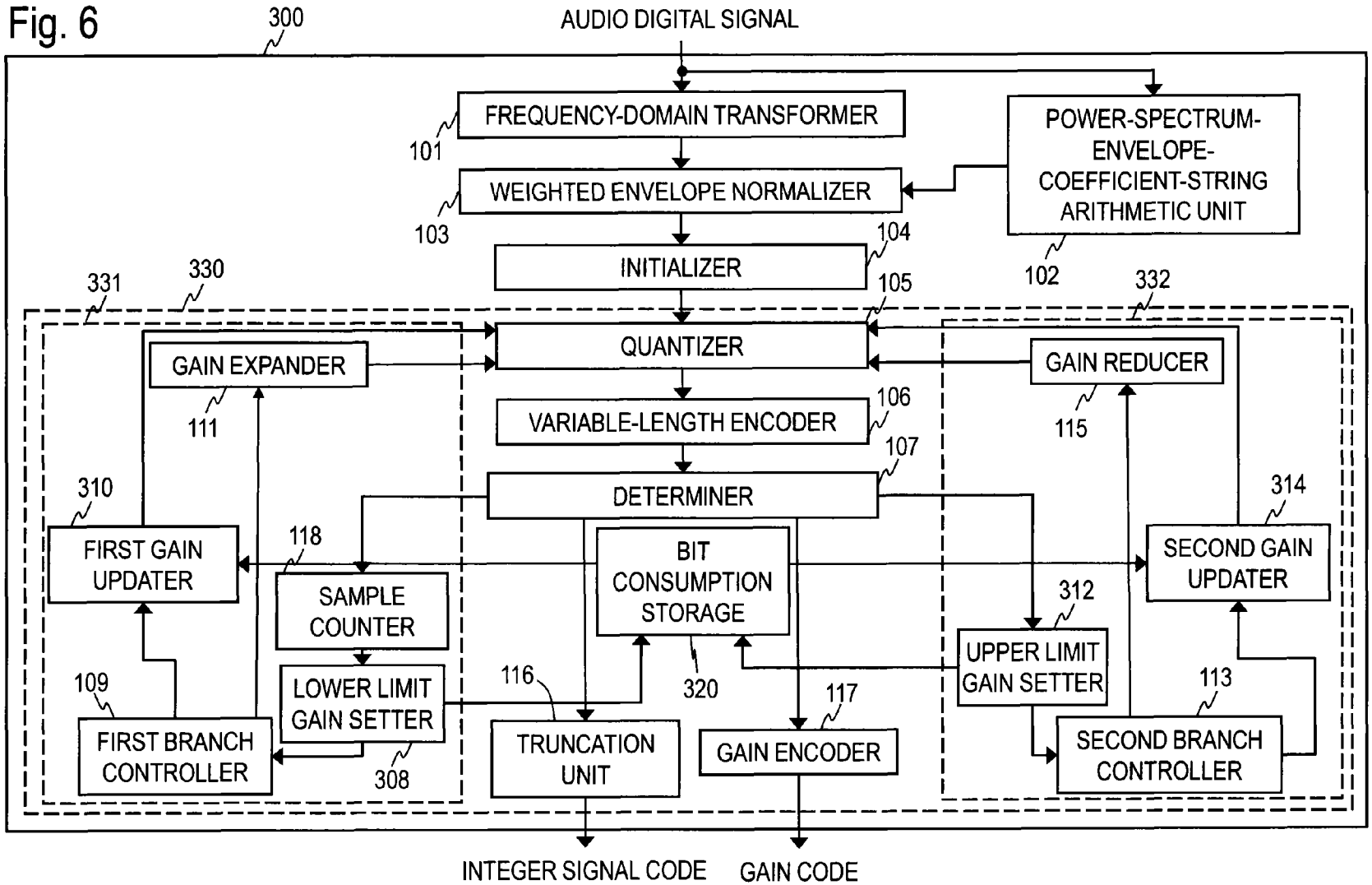
FIG. 6 is a block diagram illustrating a configuration of an encoder according to a third embodiment.

An encoding process performed by an encoder 300 of a third embodiment will be described with reference to FIG. 6. The encoder 300 of the third embodiment differs from the encoder 100 of the first embodiment in that the encoder 300 includes a lower limit gain setter 308, a first gain updater 310, an upper limit gain setter 312, a second gain updater 314, and a bit consumption storage 320 in place of the lower limit gain setter 108, the first gain updater 110, the upper limit gain setter 112 and the second gain updater 114. A gain expansion updater 331 includes a lower limit gain setter 308 and a first gain updater 310 in place of the lower limit gain setter 108 and the first gain updater 110 of the gain expansion updater 131. A gain reduction updater 332 includes an upper limit gain setter 312 and a second gain updater 314 in place of the upper limit gain setter 112 and the second gain updater 114 of the gain reduction updater 132. A gain update loop processor 330 includes the gain expansion updater 331 and the gain reduction updater 332 in place of the gain expansion updater 131 and the gain reduction updater 132 of the gain update loop processor 130. Differences from the first embodiment will be described below.

<Lower Limit Gain Setter 308>

The lower limit gain setter 308 sets the current value of gain g as the lower limit gain $g_{min}$ ($g_{min} \leftarrow g$). Additionally, the lower limit gain setter 308 stores the number c of consumed bits as the number $c_L$ of consumed-bits-at-lower-limit-setting in the bit consumption storage 320. That is, when the number c of consumed bits is greater than the number B of allocated bits, the lower limit gain setter 308 sets the number c of consumed bits as the number $c_L$ of consumed-bits-with-lower-limit-setting and stores the number $c_L$ of consumed-bits-at-lower-limit-setting in the bit consumption storage 320 in addition to performing the process in the lower limit gain setter 108 of the first embodiment.

<Upper Limit Gain Setter 312>

The upper limit gain setter 312 sets the current value of gain g as the upper limit gain $g_{max}$ ($g_{max} \leftarrow g$). Additionally the upper limit gain setter 312 stores the number c of consumed bits in the bit consumption storage 320 as the number $c_U$ of consumed-bits-at-upper-limit-setting. That is, when the number c of consumed bits is smaller than the number B of allocated bits, the upper limit gain setter 312 sets the number c of consumed bits as the number $c_U$ of consumed-bits-at-upper-limit-setting and stores the number $c_U$ of consumed-bits-at-upper-limit-setting in the bit consumption storage 320 in addition to performing the process in the upper limit gain setter 112 of the first embodiment.

<First Gain Updater 310>

When the number c of consumed bits is greater than the number B of allocated bits and the upper limit gain $g_{max}$ has already been set, the first gain updater 310 obtains at least one of an indicator of the likelihood of the lower limit gain $g_{min}$ and an indicator of the likelihood of the upper limit gain $g_{max}$ based on the number B of allocated bits, the number $c_U$ of consumed-bits-at-upper-limit-setting and the number $c_L$ of consumed-bits-at-lower-limit-setting. Note that the "indicator of the likelihood" means an indicator of the likelihood of a value of gain g.

[Indicator of Likelihood of Lower Limit Gain $g_{min}$]

The first gain updater 310 obtains an indicator w of the relative likelihood of lower limit gain $g_{min}$ according to formula A, for example.

$$w=(B-C_U)/(c_L-c_U) \quad \text{(Formula A)}$$

Formula A is the same in meaning as formula B, which is based on the difference between the number B of allocated bits and the number $c_U$ of consumed-bits-at-upper-limit-setting and the difference between the number $c_L$ of consumed-bits-at-lower-limit-setting and the number of allocate bits B, with a modification to the right-hand side of formula B.

$$w=(B-c_U)/(B-c_U+c_L-B) \quad \text{(Formula B)}$$

Therefore, the indicator w may be obtained according to formula B instead of formula A.

When the indicator w obtained according to formula A or B is large, the lower limit gain $g_{min}$ is more likely to be the value of gain; when the indicator w is small, the upper limit gain $g_{max}$ is more likely to be the value of gain g.

[Indicator of Likelihood of Upper Limit Gain $g_{max}$]

The relative likelihood of the upper limit gain $g_{max}$ is (1−w).

That is, the indicator (1−w) of the likelihood of the upper limit gain $g_{max}$ may be obtained according to formula C instead of obtaining the indicator w according to formula A or B.

$$(1-w)=(c_L-B)/(c_L-c_U) \quad \text{(Formula C)}$$

Formula C is the same in meaning as formula D, which is based on the difference $B-c_U$ between the number B of allocated bits and the number $c_U$ of consumed-bits-at-upper-limit-setting and the difference $c_L-B$ between the number $c_L$ of consumed-bits-at-lower-limit-setting and the number B of allocated bits, with a modification to the right-hand side of formula D.

$$1-w=(c_L-B)/(B-c_U+c_L-B) \quad \text{(Formula D)}$$

Therefore, the indicator (1−w) may be obtained according to formula D instead of formula C.

When the indicator (1−w) obtained according to formula A or B is large, the upper limit gain $g_{max}$ is more likely to be the value of gain g; when the indicator (1−w) is small, the lower limit gain $g_{min}$ is more likely to be the value of gain g.

The first gain updater 310 then sets and outputs a weighted mean with a greater weight assigned to the upper limit gain $g_{max}$ or lower limit gain $g_{min}$, whichever is more likely to be a new value of gain g ($g \leftarrow g_{min} \times w + g_{max} \times (1-w)$). That is, when the difference between the number B of allocated bits and the number $c_U$ of consumed-bits-at-upper-limit-setting is greater than the difference between the number $c_L$ of consumed-bits-at-lower-limit-setting and the number B of allocated bits, the lower limit gain $g_{min}$ is more likely and closer to a preferable value of the gain g.

Alternatively, the first gain updater 310 may use a constant C, which is a positive value, to obtain the indicator w with lessened weighting as $w=(B-c_U+C)/(c_L-c_U+2\times C)$. In this case, $$(1-w)=(c_L-B+C)/(c_L-c_U+2\times C)$$

and the new value of gain g is the intermediate between the arithmetic mean of the upper limit gain $g_{max}$ and the lower limit gain $g_{min}$ and the weighted mean based on the difference between the number of consumed bits and the number of allocated bits.

Note that if the number of quantized normalized samples corresponding to truncation code (the number of truncated samples Tr) has been obtained by the sample counter 118, the number Tr of truncated samples may be used instead of the difference between the number $c_L$ of consumed-bits-at-lower-limit-setting and the number B of allocated bits. This is because the greater the difference between the number $c_L$ of consumed-bits-at-lower-limit-setting and the number B of allocated bits, the greater the number Tr of truncated samples. The correlation between the difference between the number $c_L$ of consumed-bits-at-lower-limit-setting and the number B of allocated bits and the number Tr of truncated samples may be experimentally obtained beforehand and the number Tr of truncated samples may be approximately converted to the difference between the number $c_L$ of consumed-bits-at-lower-limit-setting and the number B of allocated bits. Replacing $(c_L-B)=\gamma\times Tr$, where $\gamma$ is a coefficient experimentally determined for conversion, then w can be written as $w=(B-c_U)/(B-C_u+\gamma\times Tr)$. Similarly, a constant C, which is a positive value, can be used to obtain the indicator w with lessened weighting as $w=(B-c_U+C)/(B-c_U+\gamma\times Tr+2\times C)$. That is, the first gain updater 310 may use the number B of allocated bits, the number Tr of truncated samples and the number $c_U$ of consumed-bits-at-upper-limit-setting to obtain at least one of the indicator of the likelihood of a value of lower limit gain and indicator of the likelihood of a value of upper limit gain. While it is desirable that the latest number Tr of samples obtained in the latest process in the sample counter 118 be used, the number Tr of samples obtained in an earlier process in the sample counter 118 may be used.

Then the control returns to the process in the quantizer 105.

<Second Gain Updater 314>

When the number c of consumed bits is smaller than the number B of allocated bits and the lower limit gain $g_{min}$ has already been set, the second gain updater 314 performs the same operation as that in the first gain updater 310.

The "indicator of the likelihood" described above represents toward which of the lower limit gain $g_{min}$ and the upper limit gain $g_{max}$ the value of gain g should be changed and how much in order for the gain g to approach an optimum value. Since gain g is updated to a new value based on the indicator in this embodiment, the number of updates needed for gain g to converge to an optimum value can be reduced.

The first gain updater 310 and the second gain updater 314 of this embodiment obtain at least one of the indicator of the likelihood of the value of the lower limit gain $g_{min}$ and the indicator of the likelihood of the value of the upper limit gain $g_{max}$, assign a greater weight to the lower limit gain $g_{min}$ or the upper limit gain $g_{max}$, whichever is more likely, and set the weighted mean of the lower limit gain $g_{min}$ and the upper limit gain $g_{max}$ as a new value of gain g. However, the first gain updater 310 and the second gain updater 314 may assign a greater weight to the lower limit gain $g_{min}$ or the upper limit gain $g_{max}$, whichever is more likely, and the weighted mean of the lower limit gain $g_{min}$ and the upper limit gain $g_{max}$ may be set as a new value of gain g without obtaining an indicator of the likelihood. For example, based on the number $c_U$ of consumed-bits-at-upper-limit-setting and the number $c_L$ of consumed-bits-at-lower-limit-setting and the number B of allocated bits, the first gain updater 310 and the second gain updater 314 may set $$g_{min}\times\frac{B-c_U}{c_L-c_U}+g_{max}\times\frac{c_L-B}{c_L-c_U}\quad\text{or}$$

$$g_{min}\times\frac{B-c_U+C}{c_L-c_U+2\times C}+g_{max}\times\frac{c_L-B+C}{c_L-c_U+2\times C}$$

as a new value of gain g without obtaining either of the indicators w and (1−W). It is essential only that the greater the difference between the number B of allocated bits and the number $c_U$ of consumed-bits-at-upper-limit-setting, the greater weight is assigned to the upper limit gain $g_{max}$, or the greater the difference between the number $c_L$ of consumed-bits-at-lower-limit-setting and the number B of allocated bits, the greater weight is assigned to the lower limit gain $g_{min}$, and the weighted mean of the lower limit gain $g_{min}$ and the upper limit gain $g_{max}$ is set as a new value of gain g. The process of setting a new value of gain g is not limited.

Alternatively, if the first gain updater 310 and the second gain updater 314 are configured to update gain g based on the number Tr of truncated samples, the first gain updater 310 may obtain $$g_{min}\times\frac{B-c_U}{B-c_U+\gamma\times Tr}+g_{max}\times\frac{\gamma\times Tr}{B-c_U+\gamma\times Tr}\quad\text{or}$$

$$g_{min}\times\frac{B-c_U+C}{B-c_U+\gamma\times Tr+2\times C}+g_{max}\times\frac{\gamma\times Tr+C}{B-c_U+\gamma\times Tr+2\times C}$$

as a new value of gain g.

Alternatively, a weight may be assigned to the lower limit gain $g_{min}$ or the upper limit gain $g_{max}$ and the weighted mean of the lower limit gain $g_{min}$ and the upper limit gain $g_{max}$ may be set as a new value of gain g. For example, $$(\omega_1\times g_{min}+g_{max})/(\omega_1+1)$$

may be set as a new value of gain g. Here, $\omega_1$ may be set to take a positive value greater than or equal to 1 when the $g_{min}$ is more likely, i.e. when $(B-c_U)>(c_L-B)$, take a positive value less than or equal to 1 when $g_{max}$ is more likely, i.e. when $(B-c_U)<(c_L-B)$, and increase with increasing $B-c_U$. For example, $\omega_1$ may be a monotonically increasing function value with respect to $B-c_U$. Alternatively, $$(g_{min}+\omega_2\times g_{max})/(1+\omega_2)$$

may be set as a new value of gain g. Here, $\omega_2$ may be set to take a positive value greater than or equal to 1 when the $g_{max}$ is more likely, take a positive value less than or equal to 1 when $g_{min}$ is more likely, and increase with increasing $c_L-B$. For example, $\omega_2$ may be a monotonically increasing function value with respect to $c_L-B$. Alternatively, when $g_{min}$ is more likely (when $(B-c_U)>(c_L-B)$), $$(\omega_3\times g_{min}+g_{max})/(\omega_3+1)$$

may be set as a new value of gain g, and when $g_{max}$ is more likely (when $(B-c_U)<(c_L-B)$)

$$(g_{min}+\omega_4\times g_{max})/(1+\omega_4)$$

may be set as a new value of gain g, where $\omega_3$ takes a positive value that is greater than or equal to 1 and is a monotonically increasing function value with respect to $B-c_U$, and $\omega_4$ takes a positive value that is greater than or equal to 1 and is a monotonically increasing function value with respect to $c_L-B$.

In this way, a weighted mean of the upper limit gain and the lower limit gain may be set as an updated gain where a weight based on at least the number B of allocated bits, the number $c_L$ of consumed-bits-at-lower-limit-setting and the number $c_U$ of consumed-bits-at-upper-limit-setting is assigned to at least one of the upper limit gain $g_{max}$ and the lower limit gain $g_{min}$.

[Modification of Third Embodiment]

While the third embodiment has been described wherein the lower limit gain setter 108, the upper limit gain setter 112, the first gain updater 110 and the second gain updater 114 of the first embodiment are replaced, the lower limit gain setter 108, the upper limit gain setter 112, the first gain updater 110 and the second gain updater 114 of the second embodiment may be replaced with the sections described in the third embodiment, or the lower limit gain setter 1008, the upper limit gain setter 1012, the first gain updater 1010 and the second gain updater 1014 of the encoder 1000 for TCX encoding described in [Background Art] may be replaced with the sections described in the third embodiment.

Alternatively, the lower limit gain setter 108, the upper limit gain setter 112, the first gain updater 110 and the second gain updater 114 of the modification of the first embodiment may be replaced with the sections described in the third embodiment, or the lower limit gain setter 108, the upper limit gain setter 112, the first gain updater 110 and the second gain updater 114 of the modification of the second embodiment may be replaced with the sections described in the third embodiment.

That is, when the number of bits or estimated number of bits in a code obtained by encoding a string of integer value samples obtained by dividing each sample in a sample string by gain before an update is greater than a predetermined number B of allocated bits, the gain before the update may be set as the lower limit gain $g_{min}$, the number of bits or estimated number of bits may be set as the number $c_L$ of consumed-bits-at-lower-limit-setting; when the number of bits or estimated number of bits in a code obtained by encoding a string of integer value samples obtained by dividing each sample in a sample string by the gain before an update is smaller than the predetermined number B of allocated bits, the gain before the update may be set as the upper limit gain $g_{max}$, the number of bits or estimated number of bits may be set as the number $c_U$ of consumed-bits-at-upper-limit-setting. A weight based on at least the number B of allocated bits, the number $c_L$ of consumed-bits-at-lower-limit-setting and the number $c_U$ of consumed-bits-at-upper-limit-setting may be assigned to at least one of the upper limit gain $g_{max}$ and the lower limit gain $g_{min}$ and the weighted mean of the upper limit gain and the lower limit gain may be set as an updated gain.

<Exemplary Hardware Configuration of Encoder>

An encoder according to the embodiments described above includes an input unit to which a keyboard and the like can be connected, an output unit to which a liquid-crystal display and the like can be connected, a CPU (Central Processing Unit) (which may include a memory such as a cache memory), memories such as a RAM (Random Access Memory) and a ROM (Read Only Memory), an external storage, which is a hard disk, and a bus that interconnects the input unit, the output unit, the CPU, the RAM, the ROM and the external storage in such a manner that they can exchange data. A device (drive) capable of reading and writing data on a recording medium such as a CD-ROM may be provided in the encoder as needed.

Programs for performing encoding and data required for processing by the programs are stored in the external storage of the encoder (the storage is not limited to an external storage; for example the programs may be stored in a read-only storage device such as a ROM.). Data obtained in the processing of the programs is stored on the RAM or the external storage device as appropriate. A storage device that stores data and addresses of its storage locations is hereinafter simply referred to as the "storage". Programs and the like for executing encoding are stored in the storage of the encoder.

In the encoder, the programs stored in the storage and data required for the processing of the programs are loaded into the RAM as required and are interpreted and executed or processed by the CPU. As a result, the CPU implements given functions to implement encoding.

<Addendum>

The present invention is not limited to the embodiments described above and modifications can be made without departing from the spirit of the present invention. For example, when the number of consumed bits is smaller than the number of allocated bits, the process in the gain reduction updater is performed whereas when the number of consumed bits is equal to the number of allocated bits, the determiner outputs gain and other information. However, the process in the gain reduction updater may be performed when the number of consumed bits is not greater than the number of allocated bits. Furthermore, the processes described in the embodiments may be performed not only in time sequence as is written or may be performed in parallel with one another or individually, depending on the throughput of the apparatuses that perform the processes or requirements.

If processing functions of any of the hardware entities (the encoder) described in the embodiments are implemented by a computer, the processing of the functions that the hardware entities should include is described in a program. The program is executed on the computer to implement the processing functions of the hardware entity on the computer.

The programs describing the processing can be recorded on a computer-readable recording medium. An example of the computer-readable recording medium is a non-transitory recording medium. The computer-readable recording medium may be any recording medium such as a magnetic recording device, an optical disc, a magneto-optical recording medium, and a semiconductor memory. Specifically, for example, a hard disk device, a flexible disk, or a magnetic tape may be used as a magnetic recording device, a DVD (Digital Versatile Disc), a DVD-RAM (Random Access Memory), a CD-ROM (Compact Disc Read Only Memory), or a CD-R (Recordable)/RW (ReWritable) may be used as an optical disk, MO (Magneto-Optical disc) may be used as a magneto-optical recoding medium, and an EEP-ROM (Electronically Erasable and Programmable Read Only Memory) may be used as a semiconductor memory.

The program is distributed by selling, transferring, or lending a portable recording medium on which the program is recorded, such as a DVD or a CD-ROM. The program may be stored on a storage device of a server computer and transferred from the server computer to other computers over a network, thereby distributing the program.

A computer that executes the program first stores the program recorded on a portable recording medium or transferred from a server computer temporally into a storage device of the computer. When the computer executes the processes, the computer reads the program stored on the recording medium of the computer and executes the processes according to the read program. In another mode of execution of the program, the computer may read the program directly from a portable recording medium and execute the processes according to the program or may execute the processes according to the received program each time the program is transferred from the server computer to the computer. Alternatively, the processes may be executed using a so-called ASP (Application Service Provider) service in which the program is not transferred from a server computer to the computer but process functions are implemented by instructions to execute the program and acquisition of the results of the execution. Note that the program in this mode encompasses information that is provided for processing by an electronic computer and is equivalent to the program (such as data that is not direct commands to a computer but has the nature that defines processing of the computer).

While the hardware entities are configured by causing a computer to execute a predetermined program in the embodiments described above, at least some of the processes may be implemented by hardware.

DESCRIPTION OF SYMBOLS

100, 150, 200, 250, 300, 1000: Encoder

What is claimed is:

1. An encoding method for an input sample string derived from an input audio signal in a given interval, the encoding method obtaining a gain code corresponding to a gain obtained by a gain update loop processing step of obtaining the gain by loop processing, and an integer signal code obtained by encoding a string of integer value samples obtained by dividing each sample in the sample string by the gain;

wherein the gain update loop processing step comprises:

a lower limit gain setting step of, when the number of bits or estimated number of bits in a code obtained by encoding a string of integer value samples obtained by dividing each sample in the sample string by a gain before an update is greater than a predetermined number B of allocated bits, setting the gain before the update as a lower limit $g_{min}$ of the gain;

an upper limit gain setting step of, when the number of bits or estimated number of bits in a code obtained by encoding a string of integer value samples obtained by dividing each sample in the sample string by the gain before the update is smaller than the predetermined number B of allocated bits, setting the gain before the update as an upper limit $g_{max}$ of the gain; and a gain update step of setting a weighted mean of the upper limit of the gain and the lower limit of the gain as an updated gain and outputting the updated gain, where a weight based on at least the predetermined number B of allocated bits, the number $c_L$ of consumed-bits-at-lower-limit-setting and the number $c_U$ of consumed-bits-at-upper-limit-setting is assigned to at least one of the upper limit $g_{max}$ of the gain and the lower limit $g_{min}$ of the gain, wherein the number $c_L$ of consumed-bits-with-lower-limit-setting is the number of the bits or the estimated number of the bits in the code obtained by encoding the string of the integer value samples obtained by dividing each sample in the sample string by the gain before the update when the number of the bits or the estimated number of the bits is greater than the predetermined number B; and the number $c_U$ of consumed-bits-at-upper-limit-setting is the number of the bits or the estimated number of the bits in the code obtained by encoding the string of the integer value samples obtained by dividing each sample in the sample string by the gain before the update when the number of the bits or the estimated number of the bits is smaller than the predetermined number B.

2. An encoding method for a sample string derived from an input audio signal in a given interval, the encoding method comprising:

a quantization step of quantizing a value obtained by diving each sample in the sample string by a gain to obtain a quantized normalized sample string;

a variable-length encoding step of encoding the quantized normalized sample string by variable-length encoding to obtain a sample string code;

a gain expansion update step of setting a value greater than the gain as new gain;

a gain reduction update step of setting a value smaller than the gain as new gain; and a determination step of, when the number of updates of the gain is equal to a predetermined number of updates, outputting the gain and the sample string code, when the number of updates of the gain is less than the predetermined number of updates and the number of consumed bits which is the number of bits in the sample string code is greater than a predetermined number of allocated bits, causing the gain expansion update step to be performed, and when the number of updates of the gain is less than the predetermined number of updates and the number of the consumed bits is smaller than the predetermined number of allocated bits, causing the gain reduction update step to be performed;

wherein the gain expansion update step comprises:

a lower limit gain setting step of, when the number of the consumed bits is greater than the predetermined number of allocated bits, setting a value of gain corresponding to the number of the consumed bits as a lower limit of gain; and a gain expansion step of, when the number of the consumed bits is greater than the predetermined number of allocated bits and an upper limit of the gain has not been set, updating a value of the gain so that the greater a value of A-T, the greater amount by which the value of the gain before the update increases to a value of updated gain, and causing the quantization step to be performed, where the value of A-T represents the number A of some or all of the samples in the quantized normalized sample string minus the number T of quantized normalized samples corresponding to a truncated sample string code left after removing a truncation code corresponding to amount by which the number of the consumed bits exceeds the predetermined number of allocated bits from the sample string code; and the gain reduction update step comprises:

an upper limit gain setting step of, when the number of the consumed bits is smaller than the predetermined number of allocated bits, setting a value of gain corresponding to the number of the consumed bits as an upper limit of gain; and a gain reduction step of, when the number of the consumed bits is smaller than the predetermined number of allocated bits and a lower limit of the gain has not been set, updating the value of the gain so that the greater the predetermined number of allocated bits minus the number of the consumed bits, the greater amount by which the value of the gain before the update decreases to an updated value, and causing the quantization step to be performed.

3. An encoding method for a sample string derived from an input audio signal in a given interval, the encoding method comprising:

a quantization step of quantizing a value obtained by dividing each sample in the sample string by a gain to obtain a quantized normalized sample string;

a gain expansion update step of setting a value greater than the gain as new gain;

a gain reduction update step of setting a value smaller than the gain as new gain;

a variable-length encoding step of encoding the quantized normalized sample string by variable-length encoding to obtain a sample string code; and a determination step of, when the number of updates of the gain is equal to a predetermined number of updates, causing the variable-length encoding step to be performed, when the number of updates of the gain is less than the predetermined number of updates and the number of consumed bits which is an estimated number of bits in a code corresponding to the quantized normalized sample string is greater than a predetermined number of allocated bits, causing the gain expansion update step to be performed, and when the number of updates of the gain is less than the predetermined number of updates and the number of the consumed bits is smaller than the predetermined number of allocated bits, causing the gain reduction update step to be performed;

wherein the gain expansion update step comprises:

a lower limit gain setting step of, when the number of the consumed bits is greater than the predetermined number of allocated bits, setting a value of gain corresponding to the number of the consumed bits as a lower limit of gain; and a gain expansion step of, when the number of the consumed bits is greater than the predetermined number of allocated bits and an upper limit of the gain has not been set, updating a value of the gain so that the greater a value of A-T, the greater amount by which the value of the gain before the update increases to an updated value, and causing the quantization step to be performed, where the value of A-T represents the number A of some or all of the samples in the quantized normalized sample string minus the number T of samples left after removing quantized normalized samples from the quantized normalized sample string, the quantized normalized samples directed to truncation code corresponding to amount by which the number of the consumed bits exceeds the predetermined number of allocated bits; and the gain reduction update step comprises:

an upper limit gain setting step of, when the number of the consumed bits is smaller than the predetermined number of allocated bits, setting a value of gain corresponding to the number of the consumed bits as an upper limit of gain; and a gain reduction step of, when the number of the consumed bits is smaller than the predetermined number of allocated bits and a lower limit of the gain has not been set, updating the value of the gain so that the greater the predetermined number of allocated bits minus the number of the consumed bits, the greater amount by which the value of the gain before the update decreases to an updated value, and causing the quantization step to be performed.

4. An encoding method for a sample string derived from an input audio signal in a given interval, the encoding method comprising:

a quantization step of quantizing a value obtained by dividing each sample in the sample string by a gain to obtain a quantized normalized sample string;

a variable-length encoding step of encoding the quantized normalized sample string by variable-length encoding to obtain a sample string code;

a gain expansion update step of setting a value greater than the gain as new gain;

a gain reduction update step of setting a value smaller than the gain as new gain; and a determination step of, when the number of updates of the gain is equal to a predetermined number of updates, outputting the gain and the sample string code, when the number of updates of the gain is less than the predetermined number of updates and the number of consumed bits which is the number of bits in the sample string code is greater than a predetermined number of allocated bits, causing the gain expansion update step to be performed, and when the number of updates of the gain is less than the predetermined number of updates and the number of the consumed bits is less than the predetermined number of allocated bits, causing the gain reduction update step to be performed;

wherein the gain expansion update step comprises:

a lower limit gain setting step of, when the number of the consumed bits is greater than the predetermined number of allocated bits, setting a value of gain corresponding to the number of the consumed bits as a lower limit of gain; and a gain expansion step of, when the number of the consumed bits is greater than the predetermined number of allocated bits and an upper limit of the gain has not been set, updating a value of the gain so that the greater the number of the consumed bits minus the predetermined number of allocated bits, the greater amount by which the value of the gain before the update increases to an updated value, and causing the quantization step to be performed; and the gain reduction update step comprises:

an upper limit gain setting step of, when the number of the consumed bits is smaller than the predetermined number of allocated bits, setting a value of gain corresponding to the number of the consumed bits as an upper limit of gain; and a gain reduction step of, when the number of the consumed bits is smaller than the predetermined number of allocated bits and a lower limit of the gain has not been set, updating the value of the gain so that the greater the predetermined number of allocated bits minus the number of the consumed bits, the greater amount by which the value of the gain before the update decreases to an updated value, and causing the quantization step to be performed.

5. An encoding method for a sample string derived from an input audio signal in a given interval, the encoding method comprising:

a quantization step of quantizing a value obtained by dividing each sample in the sample string by a gain to obtain a quantized normalized sample string;

a gain expansion update step of setting a value greater than the gain as new gain;

a gain reduction update step of setting a value smaller than the gain as new gain; and a determination step of, when the number of updates of the gain is equal to a predetermined number of updates, causing a variable-length encoding step to be performed, when the number of updates of the gain is less than the predetermined number of updates and the number of consumed bits which is an estimated number of bits in a code corresponding to the quantized normalized sample string is greater than a predetermined number of allocated bits, causing the gain expansion update step to be performed, and when the number of updates of the gain is less than the predetermined number of updates and the number of the consumed bits is smaller than the predetermined number of allocated bits, causing the gain reduction update step to be performed;

wherein the gain expansion update step comprises:

a lower limit gain setting step of, when the number of the consumed bits is greater than the predetermined number of allocated bits, setting a value of gain corresponding to the number of the consumed bits as a lower limit of gain; and a gain expansion step of, when the number of the consumed bits is greater than the predetermined number of allocated bits and an upper limit of the gain has not been set, updating the value of gain so that the greater the number of the consumed bits minus the predetermined number of allocated bits, the greater amount by which a value of the gain before the update increases to an updated value, and causing the quantization step to be performed;

the gain reduction update step comprises:

an upper limit gain setting step of, when the number of the consumed bits is smaller than the predetermined number of allocated bits, setting a value of gain corresponding to the number of the consumed bits as an upper limit of gain; and a gain reduction step of, when the number of the consumed bits is smaller than the predetermined number of allocated bits and a lower limit of the gain has not been set, updating the value of the gain so that the greater the predetermined number of allocated bits minus the number of the consumed bits, the greater amount by which the value of the gain before the update decreases to an updated value, and causing the quantization step to be performed; wherein the variable-length encoding steps encodes the quantized normalized sample string by variable-length encoding to obtain a sample string code.

6. The encoding method according to any one of claims 2 to 5, wherein the lower limit gain setting step further sets the number of the consumed bits as the number of consumed-bits-at-lower-limit-setting when the number of the consumed bits is greater than the predetermined number of allocated bits;

the upper limit gain setting step further sets the number of the consumed bits as the number of consumed-bits-at-upper-limit-setting when the number of the consumed bits is smaller than the predetermined number of allocated bits;

the gain expansion update step further comprises a first gain update step of, when the number of the consumed bits is greater than the predetermined number of allocated bits and an upper limit of the gain has been set, setting a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of the consumed-bits-at-lower-limit-setting, and the number of the consumed-bits-at-upper-limit-setting; and the gain reduction step further comprises a second gain update step of, when the number of the consumed bits is smaller than the predetermined number of allocated bits and a lower limit of the gain has already been set, setting a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of the consumed-bits-at-lower-limit-setting and the number of the consumed-bits-at-upper-limit-setting.

7. The encoding method according to any one of claims 2 to 5, wherein the lower limit gain setting step is the step of, when the number of the consumed bits is greater than the predetermined number of allocated bits, further setting the number of the consumed bits as the number of consumed-bits-at-lower-limit-setting;

the upper limit gain setting step is the step of, when the number of the consumed bits is smaller than the predetermined number of allocated bits, further setting the number of consumed bits as the number of consumed-bits-at-upper-limit-setting;

the gain expansion update step further comprises a first gain update step of, when the number of consumed bits is greater than the predetermined number of allocated bits and an upper limit of the gain has already been set, setting $$g_{min} \times \frac{B - c_U}{c_L - c_U} + g_{max} \times \frac{c_L - B}{c_L - c_U}$$

for the predetermined number B of allocated bits, the number $c_L$ of the consumed-bits-at-lower-limit-setting, the number $c_U$ of the consumed-bits-at-upper-limit-setting, the lower limit $g_{min}$ of the gain, and the upper limit $g_{max}$ of gain as a new value of the gain; and the gain reduction update step comprises a second gain update step of, when the number of the consumed bits is smaller than the predetermined number of allocated bits and a lower limit of the gain has been already set, setting $$g_{min} \times \frac{B - c_U}{c_L - c_U} + g_{max} \times \frac{c_L - B}{c_L - c_U}$$

as a new value of the gain.

8. The encoding method according to any one of claims 2 to 5, wherein the lower limit gain setting step is the step of, when the number of the consumed bits is greater than the predetermined number of allocated bits, further setting the number of the consumed bits as the number of consumed-bits-at-lower-limit-setting;

the upper limit gain setting step is the step of, when the number of the consumed bits is smaller than the predetermined number of allocated bits, setting the number of the consumed bits as the number of consumed-bits-at-upper-limit-setting;

the gain expansion update step further comprises a first gain update step of, when the number of the consumed bits is greater than the predetermined number of allocated bits and an upper limit of the gain has already been set, setting $$g_{min} \times \frac{B - c_U + C}{c_L - c_U + 2 \times C} + g_{max} \times \frac{c_L - B + C}{c_L - c_U + 2 \times C}$$

for the predetermined number B of allocated bits, the number $c_L$ of the consumed-bits-at-lower-limit-setting, the number $c_U$ of the consumed-bits-at-upper-limit-setting, the lower limit $g_{min}$ of the gain, the upper limit $g_{max}$ of the gain, and a positive constant C as a new value of the gain; and the gain reduction step further comprises a second gain update step of, when the number of the consumed bits is smaller than the predetermined number of allocated bits and a lower limit of the gain has already been set, setting $$g_{min} \times \frac{B - c_U + C}{c_L - c_U + 2 \times C} + g_{max} \times \frac{c_L - B + C}{c_L - c_U + 2 \times C}$$

as a new value of the gain.

9. The encoding method according to claim 2 or 3, wherein the upper limit gain setting step is the step of, when the number of the consumed bits is smaller than the predetermined number of allocated bits, setting the number of the consumed bits as the number of consumed-bits-at-upper-limit-setting;

the gain expansion update step further comprises a first gain update step of, when the number of the consumed bits is greater than the predetermined number of allocated bits and an upper limit of the gain has already been set, setting a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of quantized normalized samples corresponding to the truncation code, and the number of the consumed-bits-at-upper-limit-setting; and the gain reduction step further comprises a second gain update step of, when the number of the consumed bits is smaller than the predetermined number of allocated bits and a lower limit of the gain has already been set, setting a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of quantized normalized samples corresponding to the truncation code, and the number of the consumed-bits-at-upper-limit-setting.

10. The encoding method according to claim 2 or 3, wherein the upper limit gain setting step is the step of, when the number of the consumed bits is smaller than the predetermined number of allocated bits, setting the number of the consumed bits as the number of consumed-bits-at-upper-limit-setting;

the gain expansion update step comprises a first gain update step of, when the number of the consumed bits is greater than the predetermined number of allocated bits and an upper limit of the gain has already been set, setting $$g_{min} \times \frac{B - c_U}{B - c_U + \gamma \times Tr} + g_{max} \times \frac{\gamma \times Tr}{B - c_U + \gamma \times Tr}$$

for the predetermined number B of allocated bits, the number Tr of quantized normalized samples corresponding to the truncation code, the number $c_U$ of the consumed-bits-at-upper-limit-setting, the lower limit $g_{min}$ of the gain, the upper limit $g_{max}$ of the gain and a coefficient γ as a new value of the gain; and the gain reduction update step comprises a second gain update step of, when the number of the consumed bits is smaller than the predetermined number of allocated bits and a lower limit of the gain has already been set, setting $$g_{min} \times \frac{B - c_U}{B - c_U + \gamma \times Tr} + g_{max} \times \frac{\gamma \times Tr}{B - c_U + \gamma \times Tr}$$

as a new value of the gain.

11. The encoding method according to claim 2 or 3, wherein the upper limit gain setting step is the step of, when the number of the consumed bits is smaller than the predetermined number of allocated bits, further setting the number of the consumed bits as the number of consumed-bits-at-upper-limit-setting; and the gain expansion update step comprises a first gain update step of, when the number of the consumed bits is greater than the predetermined number of allocated bits and an upper limit of the gain has already been set, setting $$g_{min} \times \frac{B - c_U + C}{B - c_U + \gamma \times Tr + 2 \times C} + g_{max} \times \frac{\gamma \times Tr + C}{B - c_U + \gamma \times Tr + 2 \times C}$$

for the predetermined number B of allocated bits, the number Tr of quantized normalized samples corresponding to the truncation code, the number $c_U$ of the consumed-bits-at-upper-limit-setting, the lower limit $g_{min}$ of the gain, the upper limit $g_{max}$ of the gain, a coefficient γ and a positive constant C as a new value of the gain; and the gain reduction update step comprises a second gain update step of, when the number of the consumed bits is smaller than the predetermined number of allocated bits and the lower limit of the gain has already been set, setting $$g_{min} \times \frac{B - c_U + C}{B - c_U + \gamma \times Tr + 2 \times C} + g_{max} \times \frac{\gamma \times Tr + C}{B - c_U + \gamma \times Tr + 2 \times C}$$

as a new value of the gain.

12. An encoder encoding an input sample string derived from an input audio signal in a given interval, the encoder obtaining a gain code corresponding to a gain obtained by a gain update loop processor obtaining the gain by loop processing, and an integer signal code obtained by encoding a string of integer value samples obtained by dividing each sample in the sample string by the gain;

wherein the gain update loop processor comprises:

a lower limit gain setter that, when the number of bits or estimated number of bits in a code obtained by encoding a string of integer value samples obtained by dividing each sample in the sample string by a gain before an update is greater than the predetermined number B of allocated bits, sets the gain before the update as a lower limit $g_{min}$ of the gain;

an upper limit gain setter that, when the number of bits or estimated number of bits in a code obtained by encoding a string of integer value samples obtained by dividing each sample in the sample string by the gain before the update is smaller than the predetermined number B of allocated bits, sets the gain before the update as an upper limit $g_{max}$ of the gain; and a gain updater setting a weighted mean of the upper limit of the gain and the lower limit of the gain as an updated gain and outputting the updated gain, where a weight based on at least the predetermined number B of allocated bits, the number $c_L$ of consumed-bits-at-lower-limit-setting and the number $c_U$ of consumed-bits-at-upper-limit-setting is assigned to at least one of the upper limit $g_{max}$ of the gain and the lower limit $g_{min}$ of the gain, wherein the number $c_L$ of consumed-bits-with-lower-limit-setting is the number of the bits or the estimated number of the bits in the code obtained by encoding the string of the integer value samples obtained by dividing each sample in the sample string by the gain before the update when the number of the bits or the estimated number of the bits is greater than the predetermined number B; and the number $c_U$ of consumed-bits-at-upper-limit-setting is the number of the bits or the estimated number of the bits in the code obtained by encoding the string of the integer value samples obtained by dividing each sample in the sample string by the gain before the update when the number of the bits or the estimated number of the bits is smaller than the predetermined number B.

13. An encoder encoding a sample string derived from an input audio signal in a given interval, the encoder comprising:

a quantizer quantizing a value obtained by dividing each sample in the sample string by a gain to obtain a quantized normalized sample string;

a variable-length encoder encoding the quantized normalized sample string by variable-length encoding to obtain a sample string code;

a gain expansion updater setting a value greater than the gain as new gain;

a gain reduction updater setting a value smaller than the gain as new gain; and a determiner that, when the number of updates of the gain is equal to a predetermined number of updates, outputs the gain and the sample string code, when the number of updates of the gain is less than the predetermined number of updates and the number of consumed bits which is the number of bits in the sample string is greater than a predetermined number of allocated bits, causes the gain expansion updater to perform processing, and when the number of updates of the gain is less than the predetermined number of updates and the number of the consumed bits is smaller than the predetermined number of allocated bits, causes the gain reduction updater to perform processing;

wherein the gain expansion updater comprises:

a lower limit gain setter that, when the number of the consumed bits is greater than the predetermined number of allocated bits, sets a value of gain corresponding to the number of the consumed bits as a lower limit of gain; and a gain expander that, when the number of the consumed bits is greater than the predetermined number of allocated bits and an upper limit of the gain has not been set, updates a value of the gain so that the greater a value of A-T, the greater amount by which the value of the gain before the update increases to an updated gain, and causes the quantizer to perform processing, where the value of A-T represents the number A of some or all of the samples in the quantized normalized sample string minus the number T of quantized normalized samples corresponding to a truncated sample string code left after removing a truncation code corresponding to amount by which the number of the consumed bits exceeds the predetermined number of allocated bits from the sample string code,; and the gain reduction updater comprises:

an upper limit gain setter that, when the number of the consumed bits is smaller than the predetermined number of allocated bits, sets a value of gain corresponding to the number of the consumed bits as an upper limit of gain; and a gain reducer that, when the number of the consumed bits is smaller than the predetermined number of allocated bits and a lower limit of the gain has not been set, updates the value of the gain so that the greater the predetermined number of allocated bits minus the number of the consumed bits, the greater amount by which the value of the gain before the update decreases to an updated value, and causes the quantizer to perform processing.

14. An encoder encoding a sample string derived from an input audio signal in a given interval, the encoder comprising:

a quantizer quantizing a value obtained by dividing each sample in the sample string by a gain to obtain a quantized normalized sample string;

a gain expansion updater setting a value greater than the gain as new gain;

a gain reduction updater setting a value smaller than the gain as new gain;

a variable-length encoder encoding the quantized normalized sample string by variable-length encoding to obtain a sample string code; and a determiner that, when the number of updates of the gain is equal to a predetermined number of updates, causes the variable-length encoder to perform processing, when the number of updates of the gain is less than the predetermined number of updates and the number of consumed bits which is an estimated number of bits in a code corresponding to the quantized normalized sample string is greater than a predetermined number of allocated bits, causes the gain expansion updater to perform processing, and when the number of updates of the gain is less than the predetermined number of updates and the number of the consumed bits is smaller than the predetermined number of allocated bits, causes the gain reduction updater to perform processing;

wherein the gain expansion updater comprises:

a lower limit gain setter that, when the number of the consumed bits is greater than the predetermined number of allocated bits, sets a value of gain corresponding to the number of the consumed bits as a lower limit of gain; and a gain expander that, when the number of the consumed bits is greater than the predetermined number of allocated bits and an upper limit of the gain has not been set, updates a value of the gain so that the greater a value of A-T, the greater amount by which the value of the gain before the update increases to an updated value, and causes the quantizer to perform processing, where the value of A-T represents the number A of some or all of the samples in the quantized normalized sample string minus the number T of samples left after removing quantized normalized samples from the quantized normalized sample string, the quantized normalized samples directed to truncation code corresponding to amount by which the number of the consumed bits exceeds the predetermined number of allocated bits; and the gain reduction updater comprises:

an upper limit gain setter that, when the number of the consumed bits is smaller than the predetermined number of allocated bits, sets a value of gain corresponding to the number of the consumed bits as an upper limit of gain; and a gain reducer that, when the number of the consumed bits is smaller than the predetermined number of allocated bits and a lower limit of the gain has not been set, updates the value of the gain so that the greater the predetermined number of allocated bits minus the number of the consumed bits, the greater amount by which the value of the gain before the update decreases to an updated value, and causes the quantizer to perform processing.

15. An encoder encoding a sample string derived from an input audio signal in a given interval, the encoder comprising:

a quantizer quantizing a value obtained by dividing each sample in the sample string by a gain to obtain a quantized normalized sample string;

a variable-length encoder encoding the quantized normalized sample string by variable-length encoding to obtain a sample string code;

a gain expansion updater setting a value greater than the gain as new gain;

a gain reduction updater setting a value smaller than the gain as new gain; and a determiner that, when the number of updates of the gain is equal to a predetermined number of updates, outputs the gain and the sample string code, when the number of updates of the gain is less than the predetermined number of updates and the number of consumed bits which is the number of bits in the sample string code is greater than a predetermined number of allocated bits, causes the gain expansion updater to perform processing, and when the number of updates of the gain is less than the predetermined number of updates and the number of the consumed bits is less than the predetermined number of allocated bits, causes the gain reduction updater to perform processing;

wherein the gain expansion updater comprises:

a lower limit gain setter that, when the number of the consumed bits is greater than the predetermined number of allocated bits, sets a value of gain corresponding to the number of the consumed bits as a lower limit of gain; and a gain expander that, when the number of the consumed bits is greater than the predetermined number of allocated bits and an upper limit of the gain has not been set, updates a value of the gain so that the greater the number of the consumed bits minus the predetermined number of allocated bits, the greater amount by which the value of the gain before the update increases to an updated value, and causes the quantizer to perform processing; and the gain reduction updater comprises:

an upper limit gain setter that, when the number of the consumed bits is smaller than the predetermined number of allocated bits, sets a value of gain corresponding to the number of the consumed bits as an upper limit of gain; and a gain reducer that, when the number of the consumed bits is smaller than the predetermined number of allocated bits and a lower limit of the gain has not been set, updates the value of the gain so that the greater the predetermined number of allocated bits minus the number of the consumed bits, the greater amount by which the value of the gain before the update decreases to an updated value, and causes the quantizer to perform processing.

16. An encoder encoding a sample string derived from an input audio signal in a given interval, the encoder comprising:

a quantizer quantizing a value obtained by dividing each sample in the sample string by a gain to obtain a quantized normalized sample string;

a gain expansion updater setting a value greater than the gain as new gain;

a gain reduction updater setting a value smaller than the gain as new gain; and a determiner that, when the number of updates of the gain is equal to a predetermined number of updates, causes a variable-length encoder to perform processing, when the number of updates of the gain is less than the predetermined number of updates and the number of consumed bits which is an estimated number of bits in a code corresponding to the quantized normalized sample string is greater than a predetermined number of allocated bits, causes the gain expansion updater to perform processing, and when the number of updates of the gain is less than the predetermined number of updates and the number of the consumed bits is smaller than the predetermined number of allocated bits, causes the gain reduction updater to perform processing;

wherein the gain expansion updater comprises:

a lower limit gain setter that, when the number of the consumed bits is greater than the predetermined number of allocated bits, sets a value of gain corresponding to the number of the consumed bits as a lower limit of gain; and a gain expander that, when the number of the consumed bits is greater than the predetermined number of allocated bits and an upper limit of the gain has not been set, updates a value of the gain so that the greater the number of the consumed bits minus the predetermined number of allocated bits, the greater amount by which the value of the gain before the update increases to an updated value, and causes the quantizer to perform processing; and the gain reduction updater comprises:

an upper limit gain setter that, when the number of the consumed bits is smaller than the predetermined number of allocated bits, sets a value of gain corresponding to the number of the consumed bits as an upper limit of gain; and a gain reducer that, when the number of the consumed bits is smaller than the predetermined number of allocated bits and a lower limit of the gain has not been set, updates the value of the gain so that the greater the predetermined number of allocated bits minus the number of the consumed bits, the greater amount by which the value of the gain before the update decreases to an updated value, and causes the quantizer to perform processing; wherein the variable-length encoder encodes the quantized normalized sample string by variable-length encoding to obtain a sample string code.

17. The encoder according to any one of claims 13 to 16, wherein the lower limit gain setter further sets the number of the consumed bits as the number of consumed-bits-at-lower-limit-setting when the number of the consumed bits is greater than the predetermined number of allocated bits;

the upper limit gain setter further sets the number of the consumed bits as the number of consumed-bits-at-upper-limit-setting when the number of the consumed bits is smaller than the predetermined number of allocated bits;

the gain expansion updater further comprises a first gain updater that, when the number of the consumed bits is greater than the predetermined number of allocated bits and an upper limit of the gain has been set, sets a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of the consumed-bits-at-lower-limit-setting, and the number of the consumed-bits-at-upper-limit-setting; and the gain reduction updater further comprises a second gain updater that, when the number of the consumed bits is smaller than the predetermined number of allocated bits and a lower limit of the gain has already been set, sets a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of the consumed-bits-at-lower-limit-setting and the number of the consumed-bits-at-upper-limit-setting.

18. The encoder according to any one of claims 13 to 16, wherein the lower limit gain setter further sets the number of the consumed bits as the number of consumed-bits-at-lower-limit-setting when the number of the consumed bits is greater than the predetermined number of allocated bits, the upper limit gain setter further sets the number of the consumed bits as the number of consumed-bits-at-upper-limit-setting, when the number of the consumed bits is smaller than the predetermined number of allocated bits, the gain expansion updater further comprises a first gain updater that, when the number of the consumed bits is greater than the predetermined number of allocated bits and an upper limit of the gain has already been set, sets $$g_{min} \times \frac{B - c_U}{c_L - c_U} + g_{max} \times \frac{c_L - B}{c_L - c_U}$$

for the predetermined number B of allocated bits, the number $c_L$ of the consumed-bits-at-lower-limit-setting, the number $c_U$ of the consumed-bits-at-upper-limit-setting, the lower limit $g_{min}$ of the gain, and the upper limit $g_{max}$ of the gain as a new value of the gain; and the gain reduction updater comprises a second gain updater that, when the number of the consumed bits is smaller than the predetermined number of allocated bits and a lower limit of the gain has been already set, sets $$g_{min} \times \frac{B - c_U}{c_L - c_U} + g_{max} \times \frac{c_L - B}{c_L - c_U}$$

as a new value of the gain.

19. The encoder according to any one of claims 13 to 16, wherein the lower limit gain setter further sets the number of the consumed bits as the number of consumed-bits-at-lower-limit-setting when the number of the consumed bits is greater than the predetermined number of allocated bits;

the upper limit gain setter sets the number of the consumed bits as the number of consumed-bits-at-upper-limit-setting when the number of the consumed bits is smaller than the predetermined number of allocated bits;

the gain expansion updater further comprises a first gain updater that, when the number of the consumed bits is greater than the predetermined number of allocated bits and an upper limit of the gain has already been set, sets $$g_{min} \times \frac{B - c_U + C}{c_L - c_U + 2 \times C} + g_{max} \times \frac{c_L - B + C}{c_L - c_U + 2 \times C}$$

for the predetermined number B of allocated bits, the number $c_L$ of the consumed-bits-at-lower-limit-setting, the number $c_U$ of the consumed-bits-at-upper-limit-setting, the lower limit $g_{min}$ of the gain, the upper limit $g_{max}$ of the gain, and a positive constant C as a new value of the gain; and the gain reduction updater further comprises a second gain updater that, when the number of the consumed bits is smaller than the predetermined number of allocated bits and a lower limit of the gain has already been set, sets $$g_{min} \times \frac{B - c_U + C}{c_L - c_U + 2 \times C} + g_{max} \times \frac{c_L - B + C}{c_L - c_U + 2 \times C}$$

as a new value of the gain.

20. The encoder according to claim 13 or 14, wherein the upper limit gain setter sets the number of the consumed bits as the number of consumed-bits-at-upper-limit-setting when the number of the consumed bits is smaller than the predetermined number of allocated bits;

the gain expansion updater further comprises a first gain updater that, when the number of the consumed bits is greater than the predetermined number of allocated bits and an upper limit of the gain has already been set, sets a weighted mean of the lower limit of the gain and the upper limit of the gain as a new value of the gain, where a greater weight is assigned to the lower limit of the gain or the upper limit of the gain, whichever is more likely, by using the predetermined number of allocated bits, the number of quantized normalized samples corresponding to the truncation code, and the number of the consumed-bits-at-upper-limit-setting; and the gain reduction updater further comprises a second gain updater that, when the number of the consumed bits is smaller than the predetermined number of allocated bits and a lower limit of the gain has already been set, sets a weighted mean of the lower limit of the gain and the upper limit of the gain as a new value of the gain, where a greater weight is assigned to the lower limit of gain or the upper limit of gain, whichever is more likely, by using the predetermined number of allocated bits, the number of quantized normalized samples corresponding to the truncation code, and the number of the consumed-bits-at-upper-limit-setting.

21. The encoder according to claim 13 or 14, wherein the upper limit gain setter sets the number of the consumed bits as the number of consumed-bits-at-upper-limit-setting when the number of the consumed bits is smaller than the predetermined number of allocated bits;

the gain expansion updater comprises a first gain updater that, when the number of the consumed bits is greater than the predetermined number of allocated bits and an upper limit of the gain has already been set, sets $$g_{min} \times \frac{B - c_U}{B - c_U + \gamma \times Tr} + g_{max} \times \frac{\gamma \times Tr}{B - c_U + \gamma \times Tr}$$

for the predetermined number B of allocated bits, the number Tr of quantized normalized samples corresponding to the truncation code, the number $c_U$ of the consumed-bits-at-upper-limit-setting, the lower limit $g_{min}$ of the gain, the upper limit $g_{max}$ of the gain and a coefficient γ as a new value of the gain; and the gain reduction updater comprises a second gain updater that, when the number of the consumed bits is smaller than the predetermined number of allocated bits and a lower limit of the gain has already been set, sets $$g_{min} \times \frac{B - c_U}{B - c_U + \gamma \times Tr} + g_{max} \times \frac{\gamma \times Tr}{B - c_U + \gamma \times Tr}$$

as a new value of the gain.

22. The encoder according to claim 13 or 14, wherein the upper limit gain setter further sets the number of the consumed bits as the number of consumed-bits-at-upper-limit-setting when the number of the consumed bits is smaller than the predetermined number of allocated bits; and the gain expansion updater comprises a first gain updater that, when the number of the consumed bits is greater than the predetermined number of allocated bits and an upper limit of the gain has already been set, sets $$g_{min} \times \frac{B - c_U + C}{B - c_U + \gamma \times Tr + 2 \times C} + g_{max} \times \frac{\gamma \times Tr + C}{B - c_U + \gamma \times Tr + 2 \times C}$$

for the predetermined number B of allocated bits, the number Tr of quantized normalized samples corresponding to the truncation code, the number $c_U$ of the consumed-bits-at-upper-limit-setting, the lower limit $g_{min}$ of the gain, the upper limit $g_{max}$ of the gain, a coefficient γ and a positive constant C as a new value of the gain; and the gain reduction updater comprises a second gain updater that, when the number of the consumed bits is smaller than the predetermined number of allocated bits and the lower limit of the gain has already been set, sets $$g_{min} \times \frac{B - c_U + C}{B - c_U + \gamma \times Tr + 2 \times C} + g_{max} \times \frac{\gamma \times Tr + C}{B - c_U + \gamma \times Tr + 2 \times C}$$

as a new value of the gain.

23. An encoding method for a sample string derived from an input audio signal in a given interval, the encoding method obtaining a gain code corresponding to a gain obtained by a gain update loop processing step of obtaining the gain by loop processing, and an integer signal code obtained by encoding a string of integer value samples obtained by dividing each sample in the sample string by the gain;

wherein the gain update loop processing step comprises a gain expansion updating step and a gain reduction updating step;

the gain expansion updating step comprises:

a lower limit gain setting step of, when the number of consumed bits is greater than a predetermined number B of allocated bits, setting the gain before the update as a lower limit $g_{min}$ of the gain, wherein the number of the consumed bits is the number of bits or estimated number of bits in a code obtained by encoding a string of integer value samples obtained by dividing each sample in the sample string by a gain before an update; and a first gain update step of, when the number of the consumed bits is greater than the predetermined number B of allocated bits and an upper limit $g_{max}$ of the gain has been set, setting a weighted mean of the upper limit $g_{max}$ of the gain and the lower limit $g_{min}$ of the gain as an updated gain, where a weight based on at least the predetermined number B of allocated bits, the number $C_L$ of consumed-bits-at-lower-limit-setting and the number $C_U$ of consumed-bits-at-upper-limit-setting is assigned to at least one of the upper limit $g_{max}$ of the gain and the lower limit $g_{min}$ of the gain, and the number $c_L$ of consumed-bits-at-lower-limit-setting is the number of the consumed bits; and the gain reduction updating step comprises:

an upper limit gain setting step of, when the number of the consumed bits is smaller than the predetermined number B of allocated bits, setting the gain before the update as an upper limit $g_{max}$ of the gain, wherein the number of the consumed bits is the number of bits or estimated number of bits in the code obtained by encoding the string of integer value samples obtained by dividing each sample in the sample string by the gain before the update; and a second gain update step of, when the number of the consumed bits is smaller than the predetermined number B of allocated bits and the lower limit $g_{min}$ of the gain has been set, setting a weighted mean of the upper limit $g_{max}$ of the gain and the lower limit $g_{min}$ of the gain as the updated gain, where a weight based on at least the predetermined number B of allocated bits, the number $c_L$ of consumed-bits-at-lower-limit-setting and the number $c_U$ of consumed-bits-at-upper-limit-setting is assigned to at least one of the upper limit $g_{max}$ of the gain and the lower limit $g_{min}$ of the gain, and the number $c_U$ of consumed-bits-at-upper-limit-setting is the number of the consumed bit.

24. The encoding method according to claim 23, wherein the gain expansion updating step further comprises a gain expansion step of, when the number of the consumed bits is greater than the predetermined number B of allocated bits and the upper limit of the gain has not been set, updating the value of gain so that the greater the number of the consumed bits minus the predetermined number B of allocated bits, the greater amount by which a value of the gain before the update increases to an updated value; and the gain reduction updating step further comprises a gain reduction step of, when the number of the consumed bits is smaller than the predetermined number B of allocated bits and a lower limit of the gain has not been set, updating the value of the gain so that the greater the predetermined number B of allocated bits minus the number of the consumed bits, the greater amount by which the value of the gain before the update decreases to an updated value.

25. The encoding method according to any one of claims 1, 23, and 24, wherein the weighted mean in the gain update step is $$g_{min} \times \frac{B - c_U}{c_L - c_U} + g_{max} \times \frac{c_L - B}{c_L - c_U} \text{ or}$$

$$g_{min} \times \frac{B - c_U + C}{c_L - c_U + 2 \times C} + g_{max} \times \frac{c_L - B + C}{c_L - c_U + 2 \times C}$$

where C is a predetermined positive constant.

26. An encoder encoding a sample string derived from an input audio signal in a given interval, the encoder obtaining a gain code corresponding to a gain obtained by a gain update loop processor obtaining the gain by loop processing, and an integer signal code obtained by encoding a string of integer value samples obtained by dividing each sample in the sample string by the gain;

wherein the gain update loop processor comprises a gain expansion updater and a gain reduction updater;

the gain expansion updater comprises:

a lower limit gain setter that, when the number of consumed bits is greater than a predetermined number B of allocated bits, sets the gain before the update as a lower limit $g_{min}$ of the gain, wherein the number of the consumed bits is the number of bits or estimated number of bits in a code obtained by encoding a string of integer value samples obtained by dividing each sample in the sample string by a gain before an update; and a first gain updater that, when the number of the consumed bits is greater than the predetermined number B of allocated bits and an upper limit $g_{max}$ of the gain has been set, sets a weighted mean of the upper limit $g_{max}$ of the gain and the lower limit $g_{min}$ of the gain as an updated gain, where a weight based on at least the predetermined number B of allocated bits, the number $c_L$ of consumed-bits-at-lower-limit-setting and the number $C_U$ of consumed-bits-at-upper-limit-setting is assigned to at least one of the upper limit $g_{max}$ of the gain and the lower limit $g_{min}$ of the gain, and the number $c_L$ of consumed-bits-at-lower-limit-setting is the number of the consumed bits; and the gain reduction updater comprises:

an upper limit gain setter that, when the number of the consumed bits is smaller than the predetermined number B of allocated bits, sets the gain before the update as an upper limit $g_{max}$ of the gain, wherein the number of the consumed bits is the number of bits or estimated number of bits in the code obtained by encoding the string of integer value samples obtained by dividing each sample in the sample string by the gain before the update; and a second gain updater that, when the number of the consumed bits is smaller than the predetermined number B of allocated bits and the lower limit $g_{min}$ of the gain has been set, sets a weighted mean of the upper limit $g_{max}$ of the gain and the lower limit $g_{min}$ of the gain as the updated gain, where a weight based on at least the predetermined number B of allocated bits, the number $c_L$ of consumed-bits-at-lower-limit-setting and the number $c_U$ of consumed-bits-at-upper-limit-setting is assigned to at least one of the upper limit $g_{max}$ of the gain and the lower limit $g_{min}$ of the gain, and the number $c_U$ of consumed-bits-at-upper-limit-setting is the number of the consumed bit.

27. The encoder according to claim 26, wherein the gain expansion updater further comprises a gain expander that, when the number of the consumed bits is greater than the predetermined number B of allocated bits and the upper limit of the gain has not been set, updates the value of gain so that the greater the number of the consumed bits minus the predetermined number B of allocated bits, the greater amount by which a value of the gain before the update increases to an updated value; and the gain reduction updater further comprises a gain reducer that, when the number of the consumed bits is smaller than the predetermined number B of allocated bits and a lower limit of the gain has not been set, updates the value of the gain so that the greater the predetermined number B of allocated bits minus the number of the consumed bits, the greater amount by which the value of the gain before the update decreases to an updated value.

28. The encoder according to any one of claims 12, 26, and 27, wherein the weighted mean in the gain updater is $$g_{min} \times \frac{B - c_U}{c_L - c_U} + g_{max} \times \frac{c_L - B}{c_L - c_U} \text{ or}$$

$$g_{min} \times \frac{B - c_U + C}{c_L - c_U + 2 \times C} + g_{max} \times \frac{c_L - B + C}{c_L - c_U + 2 \times C}$$

where C is a predetermined positive constant.

29. A non-transitory computer-readable recording medium storing a program for causing a computer to execute the steps of the encoding method according to any one of claims to 1, 2, 5, 23, and 24.

* * * * *